US006582867B2

(12) United States Patent
Serizawa et al.

(10) Patent No.: US 6,582,867 B2
(45) Date of Patent: Jun. 24, 2003

(54) TONER FOR DEVELOPING ELECTROSTATIC LATENT IMAGE, PROCESS FOR PRODUCING THE SAME, AND PROCESS FOR FORMING IMAGE

(75) Inventors: Manabu Serizawa, Minamiashigara (JP); Katsumi Daimon, Minamiashigara (JP); Norihito Fukushima, Minamiashigara (JP); Takashi Imai, Minamiashigara (JP); Hirokazu Hamano, Minamiashigara (JP)

(73) Assignee: Fuji Xerox Co., Ltd., Tokyo (JP)

( * ) Notice: Subject to any disclaimer, the term of this patent is extended or adjusted under 35 U.S.C. 154(b) by 12 days.

(21) Appl. No.: 09/935,712

(22) Filed: Aug. 24, 2001

(65) Prior Publication Data

US 2002/0055050 A1 May 9, 2002

(30) Foreign Application Priority Data

Aug. 30, 2000 (JP) ..... 2000-260311
Oct. 3, 2000 (JP) ..... 2000-303912

(51) Int. Cl.[7] ..... G03G 9/00
(52) U.S. Cl. ..... 430/108.4; 430/111.4; 430/137.4
(58) Field of Search ..... 430/108.4, 111.4, 430/137.14

(56) References Cited

U.S. PATENT DOCUMENTS 6,475,688 B1 * 11/2002 Tamura et al. ..... 430/108.3

FOREIGN PATENT DOCUMENTS

| | | |
|---|---|---|
| JP | A 62-129867 | 6/1987 |
| JP | A 62-170971 | 7/1987 |
| JP | A 62-170972 | 7/1987 |
| JP | A 62-205365 | 9/1987 |
| JP | A 62-276565 | 12/1987 |
| JP | A 62-276566 | 12/1987 |
| JP | A 63-38949 | 2/1988 |
| JP | A 63-38950 | 2/1988 |
| JP | A 63-38951 | 2/1988 |
| JP | A 63-38952 | 2/1988 |
| JP | A 63-38953 | 2/1988 |
| JP | A 63-38954 | 2/1988 |
| JP | A 63-38955 | 2/1988 |
| JP | A 63-38956 | 2/1988 |
| JP | A 63-282752 | 11/1988 |
| JP | A 5-1217 | 1/1993 |
| JP | A 5-5056 | 1/1993 |
| JP | A 5-112715 | 5/1993 |
| JP | A 6-148936 | 5/1994 |
| JP | A 6-194874 | 7/1994 |
| JP | A 6-250439 | 9/1994 |

* cited by examiner

*Primary Examiner*—Mark A. Chapman
(74) *Attorney, Agent, or Firm*—Oliff & Berridge, PLC

(57) ABSTRACT

A toner for developing an electrostatic latent image, a process for producing the same and a process for forming an image using the same are provided. The toner is produced by a simple production process, with good reproducibility, particularly in particle size and particle size distribution. The toner is excellent in production stability, with a wide fixing region, and is also excellent in low temperature fixing property, production stability, storage stability of resin particles formed by the aggregation process, and charging property, particularly environmental stability and time-lapse stability. The toner for developing an electrostatic latent image contains a crystalline resin having a melting point as a binder resin, and at least one of an ester compound having an alkyl group having from 6 to 32 carbon atoms and a resin having a contact angle with water that is smaller than that of the crystalline resin.

14 Claims, 1 Drawing Sheet

TONER FOR DEVELOPING ELECTROSTATIC LATENT IMAGE, PROCESS FOR PRODUCING THE SAME, AND PROCESS FOR FORMING IMAGE

BACKGROUND OF THE INVENTION

1. Field of the Invention

The present invention relates to a toner for developing an electrostatic latent image that is suitable for forming a high quality image by an electrophotographic process, a process for producing the same, and a process for forming an image.

2. Description of the Related Art

A process for visualizing image information through an electrostatic latent image is being widely applied to various fields. In the electrophotographic process, an electrostatic latent image is formed on a photoreceptor through a charging step and an exposing step, and the electrostatic latent image is visualized through a developing step, a transferring step and a fixing step.

In the electrophotographic process, an electrostatic latent image formed on a photoreceptor through a charging step and an exposing step is developed with a developer and then transferred. The toner on a fixing material through the transferring step is heated and melted by a fixing member having a heating unit in the fixing step, whereby the toner image is fixed on the surface of the fixing material. In the fixing step, the fixing member heats not only the toner but also the fixing material to the necessary temperature, so as to fix the toner on the fixing material. When the heating of the fixing material is insufficient, so-called cold offset occurs, in which only the toner is melted, and the toner is adhered on the fixing member. When the heating is excessive, so-called hot offset occurs, in which the viscosity of the toner is decreased, and a part or the whole of the fixed image is adhered on the fixing member. Therefore, the heating by the fixing member necessarily falls within a fixing region, in which the cold offset and the hot offset do not occur.

According to an increasing demand for energy saving, the fixing temperature of the toner is necessarily decreased in order to realize energy saving of the fixing step, which consumes a certain extent of the consumed electric power of a duplicator, and enhancement of the fixing region. The decrease in the fixing temperature of the toner not only realizes the energy saving and the enhancement of the fixing region, but also shortens the so-called warm-up time, i.e., the latency time until the surface of a fixing roll reaches the temperature capable of conducting fixing upon turning on a duplicator, and enhances the service life of the fixing roll.

When the fixing temperature of the toner is lowered, it brings about decrease of the glass transition point of the toner to cause such a problem that the storage stability of the toner is deteriorated, and thus both the properties cannot be attained at the same time. In order to realize both the low fixing temperature and the storage stability of the toner, it is necessary that the toner has the so-called sharp melt property, i.e., the viscosity of the toner is quickly lowered at a high temperature region while the glass transition point of the toner is maintained at a high temperature.

However, because a resin used in the toner generally has fluctuation ranges in the glass transition point and the molecular weight, it is necessary that the composition and the molecular weight of the resin are uniformed to obtain the sharp melt property. In order to obtain such a resin, the molecular weight of the resin is necessarily uniformed by employing a special production process or by treating the resin with chromatography, whereby the production cost of the resin is considerably increased. Furthermore, it is not preferred from the standpoint of environmental protection since an unnecessary portion of the resin is formed.

As a method for lowering the fixing temperature of the toner, the use of a crystalline resin as the binder resin is proposed (as described in Japanese Patent Laid-Open Nos. 129867/1987, 170971/1987, 170972/1987, 205365/1987, 276565/1987, 276566/1987, 38949/1988, 38950/1988, 38951/1988, 38952/1988, 38953/1988, 38954/1988, 38955/1988, 38956/1988, 1217/1993, 148936/1994, 194874/1994, 5056/1993 and 112715/1993).

Although the fixing temperature can be lowered by these methods, since the gradient of the viscosity of the resin with respect to the temperature change is large, the sufficient viscosity cannot be obtained upon production of the toner, for example, upon kneading, and thus the dispersibility of a colorant and a releasing agent in the resin is not stabilized, whereby such a problem occurs that a toner having unevenness in the coloring property and the fixing property is liable to occur. Furthermore, pulverization of the kneaded product becomes difficult to cause such a problem that a toner having a small particle diameter is difficult to be obtained.

In order solve the problems, a method can be employed in that an auxiliary agent, such as a thickening agent and a pulverizing aid, is added, but is not preferred since these auxiliary agents are dispersed in the resin to deteriorate the crystallinity of the binder resin.

In recent years, an aggregation and coalescence process is proposed as a process for producing a toner, the particle shape or the surface composition of which is controlled according to the purpose (Japanese Patent Laid-Open Nos. 282752/1988 and 250439/1994). The aggregation and coalescence process is conducted in the following manner. A resin particle dispersion is produced by an emulsion polymerization process or a dispersion emulsification process, and separately, a colorant dispersion having a colorant dispersed in a solvent is produced. The dispersions are mixed to form aggregated particles having a diameter corresponding to a toner particle diameter and then subjected to heating and fusing to obtain toner particles. According to the aggregation and coalescence process, the toner shape can be arbitrarily controlled from an irregular shape to a spherical shape by selecting the conditions for heating temperatures.

It is general in the aggregation process that the resin particles are heated to a temperature near the glass transition temperature to partially melt the surface of the resin particles, whereby the aggregated particles are easily produced, and the crystalline resin can be subjected to the formation of aggregated particles. However, because the surface of the crystalline resin particles suffers great change in viscosity particularly near the melting point, the temperature range, within which the surface of the resin particles can be partially melted, is narrow in comparison to an ordinary noncrystalline resin. Thus, in the case where the aggregation temperature is low, the aggregated particles are unstable and easily broken, and in the case where the aggregation temperature is high, the particles are easily grown to cause a problem in that the controllability in particle size is deteriorated. In the case of the aggregation process using the crystalline resin, it is necessary to obtain emulsified particles that some kind of a dispersant or a hydrophilic functional group is contained in the resin, and it is not preferred since the crystallinity of the resin is deteriorated.

SUMMARY OF THE INVENTION

The invention has been made in view of the foregoing circumstances to solve the problems associated with the conventional toner, particularly a full color toner, for developing an electrostatic latent image, and is to provide:

(1) A toner for developing an electrostatic latent image and a developer for developing an electrostatic latent image that has a wide fixing temperature range and are excellent in fixing property at a low temperature;

(2) A toner for developing an electrostatic latent image and a developer for developing an electrostatic latent image that are excellent in charging property, particularly in environmental stability and time-lapse stability;

(3) A toner for developing an electrostatic latent image and a developer for developing an electrostatic latent image that can be easily produced, and are excellent in reproducibility of the particle shape and the particle size distribution and excellent in production stability;

(4) A toner for developing an electrostatic latent image and a developer for developing an electrostatic latent image that are excellent in production stability and storage stability of the binder resin particles;

(5) A process for producing the toner for developing an electrostatic latent image in a stable manner;

(6) A process for enabling stable formation of an image by using the toner for developing an electrostatic latent image; and (7) An apparatus for enabling stable formation of an image by using the toner for developing an electrostatic latent image.

According to an aspect of the invention, the toner for developing an electrostatic latent image contains a crystalline resin having a melting point as a binder resin, and the toner further contains at least one compound which is selected from (a) an ester compound having an alkyl group having from 6 to 32 carbon atoms and (b) a resin having a contact angle with water that is smaller than that of the crystalline resin.

According to another aspect of the invention, the process for producing a toner for developing an electrostatic latent image contains the steps of: mixing by agitating a binder resin particle dispersion and an aggregated particle stabilizer dispersion to prepare an aggregated particle dispersion containing the binder resin particles; and heating the aggregated particle dispersion to a temperature higher than a melting point of a crystalline resin contained in the binder resin to form toner particles.

According to a further aspect of the invention, a process for forming an image contains the steps of: forming an electrostatic latent image; developing the electrostatic latent image with a developer to form a toner image; transferring the toner image to a fixing substrate; and fixing the toner image to the fixing substrate. In the process, the toner for developing an electrostatic latent image described in the above aspect is used to form the toner image.

BRIEF DESCRIPTION OF THE DRAWING

A preferred embodiment of the invention will be described in detail based on the following figure, wherein.

DESCRIPTION OF THE PREFERRED EMBODIMENTS

Figure 1:
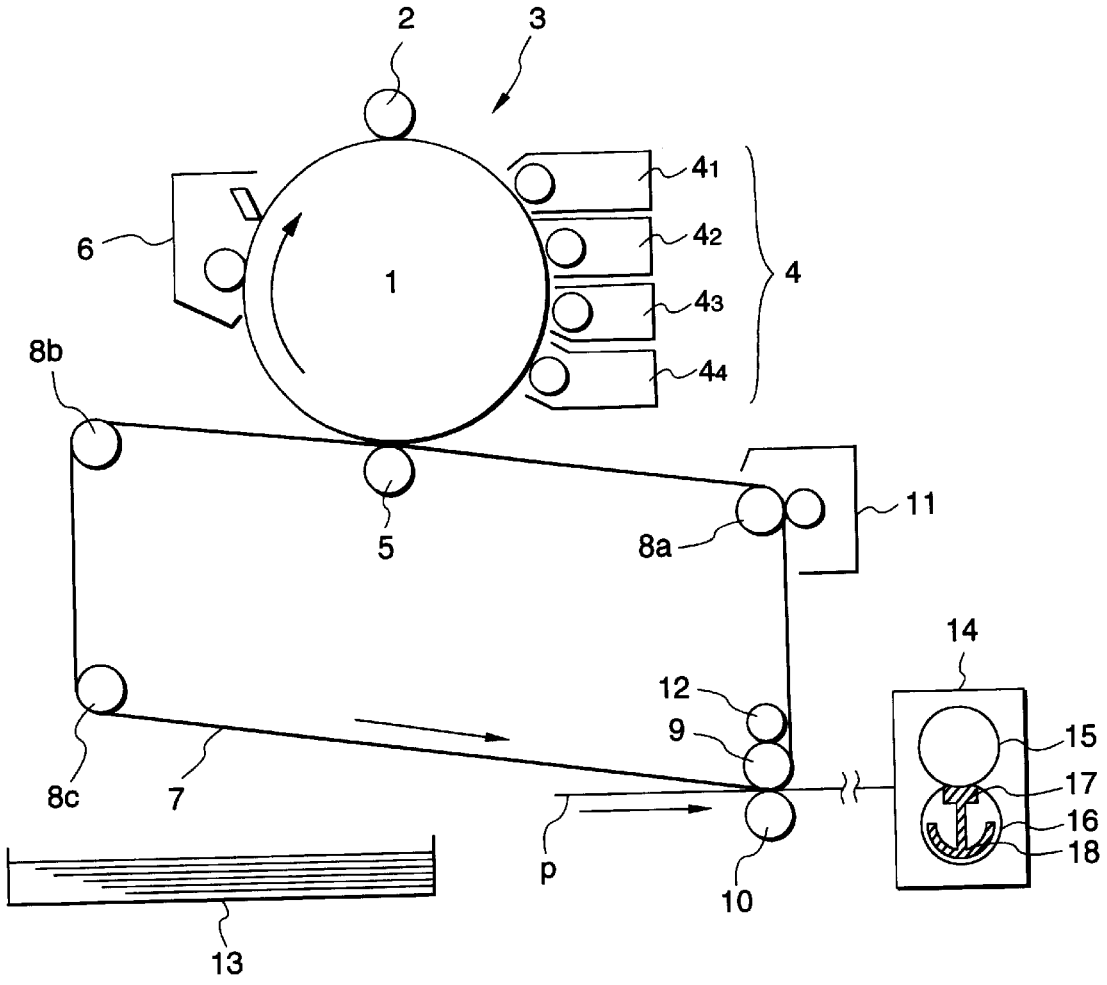
FIG. 1 is a conceptual diagram showing an example of an apparatus for forming an image for conducting the process for forming an image according to the invention.

In the invention, the toner contains a crystalline resin having a melting point as a binding resin and further contains at least one of an ester compound having an alkyl group having from 6 to 32 carbon atoms and a resin having a contact angle with water that is smaller than that of the crystalline resin, whereby it is succeeded that the stability of the aggregated particles in the dispersion is ensured, and the crystallinity of the binder resin is maintained. The stability of the aggregated particles greatly improves dispersibility of a colorant and a releasing agent in the binder resin upon production of the toner by the aggregation and coalescence process, and the maintenance of the crystallinity of the binder resin enables maintenance of low temperature fixing property, whereby a toner for developing an electrostatic latent image that is excellent in low temperature fixing property and color developing property can be provided.

In general, a crystalline resin suffers great decrease in viscosity at a particular temperature because it has a melting point, and the temperature difference from the start of thermal activity of the resin molecules to the temperature range where fixing can be conducted can be decreased, whereby an excellent fixing property can be provided. On the other hand, a noncrystalline resin suffers gradual decrease in viscosity to provide a large temperature difference from the start of thermal activity of the resin molecules at the glass transition point to the temperature where fixing property can be conducted, and therefore the low temperature fixing property cannot be ensured.

According to the invention, the use of the crystalline resin having a melting point is enabled to ensure an excellent low temperature fixing property.

A crystalline resin having a melting point in a range of from 45 to 110° C. is suitable as the crystalline resin of the invention to ensure the low temperature fixing property and the storage stability of the toner. When the melting point is lower than 45° C., storage of the toner becomes difficult, and when the melting point exceeds 110° C., the effect of the low temperature fixing property cannot be enjoyed. The melting point of the crystalline resin is preferably in a range of from 50 to 100° C., and more preferably in a range of from 55 to 90° C. The melting point of the resin mentioned above was obtained by the process shown in JIS K-7121.

It is advantageous that the toner of the invention has a small particle diameter and a narrow particle size distribution, and is suitably produced by an aggregation and coalescence process, in which resin particles and colorant particles are aggregated and coalesced. In the production of the aggregated particles in this process, it is considered that the resin particles and colorant particles dispersed and emulsified to a submicron size exhibiting the Brownian motion form aggregated particles having a diameter of about from 1 to 2 $\mu$m due to the presence of an aggregating agent, i.e., the so-called thermal motion aggregation occurs, and furthermore, the aggregated particles are further aggregated to adjust the particle size by heating the aggregated particle dispersion, i.e., the so-called flow transportation aggregation occurs.

Because the thermal motion aggregation and the flow transportation aggregation do not simultaneously occur, it is necessary to stably produce the aggregated particles having a diameter of about from 1 to 2 $\mu$m in order to finally obtain particles having a narrow particle size distribution. When the aggregation in the flow transportation aggregation region occurs before sufficiently proceeding the thermal motion aggregation, the aggregation proceeds with fine particles remaining, and thus it is not preferred since the particle size distribution of the toner is broadened.

The crystalline resin of the invention is hard to be affected by the temperature below the melting point since a part or the whole of the resin molecules is regularly arranged. Therefore, there is a tendency that the stability of the aggregated particles having a diameter of about from 1 to 2 μm formed by thermal motion aggregation becomes low. Furthermore, when an emulsifier, such as a surfactant, is used in the stage of emulsification, the stability of the aggregated particles is further lowered.

In the invention, an ester compound having an alkyl group having from 6 to 23 carbon atoms is contained in the toner containing a crystalline resin as a binder resin, so as to ensure the stability of the aggregated particles with maintaining the low temperature fixing property of the crystalline resin, whereby improving the dispersibility of a colorant and a releasing agent in the binder resin containing the crystalline resin. That is, it is considered that the ester compound containing an alkyl group improves the compatibility with the colorant and the releasing agent by slightly dissolving with the crystalline part of the crystalline resin, and the partial breakage of the crystallinity of the crystalline resin improves the stability of the aggregated particles formed by thermal motion aggregation, whereby the dispersibility of the colorant and the releasing agent in the binder resin containing the crystalline resin is improved. The improvement in the dispersibility of the colorant and the releasing agent greatly improves the coloring property and the fixing property of the toner. Since the compound contains an alkyl group to have low compatibility with the crystalline resin in a molten state, it does not inhibit the crystallinity of the binder resin in the steps of melting, cooling and integration, whereby the advantage of the low temperature fixing property of the crystalline resin can be enjoyed.

Furthermore, the combination use of the particular resin (the resin having appropriate hydrophilicity) not only improves the hydrophilicity of the various particles upon aggregation for forming aggregated particles by an aggregation process, but also makes particles having high hydrophilicity within the aggregated particles be present on the surface of the aggregated particles due to the difference of contact angles between the crystalline resin particles and the particular resin particles, whereby the stability of the aggregated particles is improved.

When the toner for developing an electrostatic latent image of the invention satisfies the following property: when the temperature is changed within a temperature range of about from 40 to 110° C., the value of the storage elastic modulus (GL) and a loss elastic modulus (GN) have an area which is changed by $10^2$ or more at a temperature of 10° C., a necessary viscosity can be obtained at the fixing temperature, and the low temperature fixing property can be ensured. When the toner does not satisfied such a property, the necessary viscosity for fixing cannot be obtained, and thus the fixing temperature should be increased, whereby the low temperature fixing property cannot be obtained. The storage elastic modulus (GL) and the loss elastic modulus (GN) are more preferably changed by $10^2$ or more at a temperature difference of 10° C. within a temperature range of from 60 to 90° C.

It is preferred that the toner for developing an electrostatic latent image of the invention satisfies the following equation (1):

$$0 \leqq |\log GL(Tm+20) - \log GL(Tm+50)| \leqq 1.5 \quad (1)$$

wherein Tm represents a melting point, GL(Tm+20) represents a storage elastic modulus at Tm+20° C., and GL(Tm+50) represents a storage elastic modulus at Tm+50° C. It is also preferred that the toner of the invention satisfies the following equation (2):

$$0 \leqq |\log GN(Tm+20) - \log GN(Tm+50)| \leqq 1.5 \quad (2)$$

wherein GN(Tm+20) represents a loss elastic modulus at Tm+20° C., and GN(Tm+50) represents a loss elastic modulus at Tm+50° C. In the foregoing equations, when the value exceeds 1.5, it is not preferred since hot offset is liable to occur upon high temperature fixing due to large dependence on the fixing temperature.

When the toner for developing an electrostatic latent image of the invention has a loss tangent tan δ at Tm+20° C., where Tm represents the melting point of the toner, satisfying $0.01 \leqq \tan\delta \leqq 2$ at an angular frequency of 1 rad/sec, excessive penetration into a fixing substrate, such as paper, can be prevented, and simultaneously, the temperature region where fixing can be conducted can be broadened. The loss tangent tan δ preferably satisfies $0.1 \leqq \tan\delta \leqq 1.8$.

The crystalline resin used as the binder resin in the invention is not particularly limited in species as far as it has a melting point in a range of from 45 to 110° C. The melting point of the crystalline resin is preferably in a range of from 50 to 100° C., and more preferably in a range of from 55 to 90° C. It is preferred that the toner containing the binder resin of the invention contains such a crystalline resin that can satisfy the following property: when the temperature is changed within a temperature range of about from 40 to 110° C., the value of the storage elastic modulus (GL) and a loss elastic modulus (GN) have an area which is changed by $10^2$ or more at a temperature of 10° C. The storage elastic modulus (GL) and the loss elastic modulus (GN) are more preferably changed by $10^2$ or more at a temperature difference of 10° C. within a temperature range of from 60 to 90° C.

A monomer constituting the crystalline resin of the invention is not particularly limited, and specific examples thereof include vinyl series resins using the following monomers:

(1) A dicarboxylic acid having a long-chain alkyl group, such as adipic acid, pimelic acid, suberic acid, azelaic acid, sebacic acid, dodecanoic diacid and tridecanoic diacid;

(2) A (meth)acrylate having a long-chain alkyl or alkenyl group, such as amyl (meth)acrylate, hexyl (meth) acrylate, heptyl (meth)acrylate, octyl (meth)acrylate, nonyl (meth)acrylate, decyl (meth)acrylate, undecyl (meth)acrylate, tridecyl (meth)acrylate, myristyl (meth)acrylate, cetyl (meth)acrylate, stearyl (meth) acrylate, oleyl (meth)acrylate and behenyl (meth) acrylate.

A polyester resin using a diol having a long-chain alkyl or alkenyl group, such as butanediol, pentanediol, hexanediol, heptanediol, octanediol, nonanediol, decanediol and butyl alcohol.

The crystalline resin of the invention may contain, in addition to the foregoing monomers, a compound containing an alkyl group, an alkenyl group and an aromatic ring having a shorter chain for adjusting the melting point and the molecular weight. Specific examples thereof include the following:

(1) For the case where the monomer is a dicarboxylic acid, an alkyl dicarboxylic acid, such as succinic acid, malonic acid and oxalic acid, an aromatic dicarboxylic acid, such as phthalic acid, isophthalic acid, terephthalic acid, homo phthalic acid, 4,4-bibenzoic acid, 2,6-naphthalenedicarboxylic acid and 1,4-naphthalenecarboxilic acid; and a nitrogen-containing aromatic dicarboxylic acid, such as dipicolinic acid, dinicotinic acid, quinolinic acid and 2,3-pyrazinedicarboxylic acid;

(2) For the case where the monomer is a diol, a diol having a short-chain alkyl group, such as ethylene grycol, propylene grycol; and (3) As a vinyl series monomer having a short-chain alkyl group, a (meth)acrylate of a short-chain alkyl or alkenyl, such as methyl (meth)acrylate, ethyl (meth) acrylate, propyl (meth)acrylate and a butyl (meth) acrylate, a vinyl nitrile, such as acrylonitrile and methacrylonitrile, a vinyl ether, such as vinyl methyl ether and vinyl isobutyl ether, a vinyl ketone, such as vinyl methyl ketone, vinyl ethyl ketone and vinyl isopropenyl ketone, and an olefin, such as ethylene, propylene, butadiene and isoprene.

These monomers may be used singly or in combination of two or more of them.

Since the crystalline resin is poor in emulsion dispersibility by its nature, an emulsifier, such as a surfactant, is added. The use of an emulsifier is preferably suppressed because the addition of an emulsifier brings about problems of decrease in charge amount of the particles and prolongation of a washing step for preventing the decrease in charge amount. In the invention, in the case where a sulfonyl group-containing monomer is mixed upon polymerization of the crystalline resin, the dispersion stability of the aggregated particles can be maintained even when the use amount of the emulsifier is decreased. The species of the sulfonyl group-containing monomer is not particularly limited as far as it can be copolymerized. Specific examples thereof include, for the case where the resin is a polyester, a dicarboxylic acid compound having a sulfonyl group directly substituted on the aromatic ring, such as sodium sulfonylterephthalate and sodium 3-sulfonylisophthalate, and for the case where the resin is a vinyl series resin, a sulfonyl group-substituted aromatic vinyl compound, such as a styrene derivative having a sulfonyl group at one of the o-, m- and p-positions and a sulfonyl group-containing vinylnaphthalene.

The crystalline resin particle dispersion in the invention is liable to cause aggregation by thermal motion aggregation. Even though the aggregation can be suppressed by adding a dispersant or an emulsifier, there are problems of decrease in charge amount of the particles and prolongation of a washing step for preventing the decrease in charge amount as described in the foregoing. The resin particle dispersion is preferably stored at a temperature of 40° C. or less, and more preferably 20° C. or less. When it is stored at a temperature exceeding 40° C., it is necessary to re-disperse the aggregated particles upon dispersion, and therefore it is not preferred since the dispersion uniformity cannot be ensured, and extra energy for agitating the aggregated particles becomes necessary.

A crosslinking agent may be added to the binder resin of the invention depending on necessity for preventing hot offset upon fixing in a high temperature region. Specific examples of the crosslinking agent include the following:

(1) An aromatic polyvinyl compound, such as divinylbenzene and divinylnaphthalene;

(2) A polyvinyl ester of an aromatic polyvalent carboxylic acid, such as divinyl phthalate, divinyl isophthalate, divinyl terephthalate, divinyl homophthalate, divinyl or trivinyl trimesate, divinyl naphthalenedicarboxylate and divinyl biphenylcarboxylate;

(3) A divinyl ester of a nitrogen-containing aromatic compound, such as divinyl pyridinecarboxylate;

(4) An unsaturated heterocyclic compound, such as pyrrole and thiophene;

(5) A vinyl ester of a carboxylic acid of an unsaturated heterocyclic compound, such as vinyl pyromucinate, vinyl furancarboxylate, vinyl pyrrole-2-carboxylate and vinyl thiophenecarboxylate;

(6) A (meth)acrylate of a linear polyhydric alcohol, such as butanediol methacrylate, hexanediol acrylate, octanediol methacrylate, decanediol acrylate and dodecanediol methacrylate;

(7) A (meth)acrylate of a branched or substituted polyhydric alcohol, such as neopentyl glycol dimethacrylate and 2-hydroxy-1,3-diacryloxypropane;

(8) Polyethylene glycol di(meth)acrylate and polypropylene polyethylene glycol di(meth)acrylate; and (9) A polyvinyl ester of a polyvalent carboxylic acid, such as divinyl succinate, divinyl fumarate, vinyl or divinyl maleate, divinyl diglycolate, vinyl or divinyl itaconate, divinyl acetonedicarboxylate, divinyl glutarate, divinyl 3,3'-thiodipropionate, divinyl or trivinyl trans-aconitate, divinyl adipate, divinyl pimelate, divinyl suberate, divinyl azelate, divinyl sebacate, divinyl didodecanate and divinyl brassylate.

Particularly in the case where the resin is a polyester, such a method may be employed in that an unsaturated polycarboxylic acid, such as fumaric acid, maleic acid, itaconic acid and trans-aconitic acid, is copolymerized in the polyester, and then crosslinking is effected by using the multiple bond parts in the resin or other vinyl series compounds.

In the invention, these crosslinking agents may be used singly or in combination of two or more of them.

The crosslinking method may be such a method that the monomer is with the crosslinking agent to effect crosslinking, or in alternative, such a method that the unsaturated bond parts are left in the resin, and after polymerizing the resin or after producing the toner, crosslinking is effected by a crosslinking reaction of the unsaturated bond parts.

In the case where the binder resin used in the toner of the invention is polyester, the monomer may be polymerized by condensation polymerization.

As a catalyst for condensation polymerization, known compounds may be used, and specific examples thereof include titanium tetrabutoxide, dibutyltin oxide, germanium dioxide, antimony trioxide, tin acetate, zinc acetate and tin disulfide.

In the case where the binder resin used in the toner of the invention is a vinyl series resin, the monomer may be polymerized by radical polymerization.

An initiator for radical polymerization is not particularly limited as far as it can initiate emulsion polymerization. Specific examples thereof include the following:

(1) A peroxide, such as hydrogen peroxide, acetyl peroxide, cumyl peroxide, tert-butyl peroxide, propyonyl peroxide, benzoyl peroxide, chlorobenzoyl peroxide, dichlorobenzoyl peroxide, bromomethylbenzoyl peroxide, lauroyl peroxide, ammonium persulfate, sodium persulfate, potassium persulfate, diisopropyl peroxycarbonate, tetralin hydroperoxide, 1-phenyl-2-methylpropyl-1-hydroperoxide, tert-butyl triphenylperacetate hydroperoxide, tert-butyl performate, tert-butyl peracetate, tert-butyl perbenzoate, tert-butyl phenylperacetate, tert-butyl methoxyperaceate and tert-butyl N-(3-toluyl)percarbamate;

(2) An azo compound, such as 2,2'-azobispropane, 2,2'-dichloro-2,2'-azobispropane, 1,1'-azo(methylethyl)

diacetate, 2,2'-azobis(2-amidinopropane) hydrochloride, 2,2'-azobis(2-amidinopropane) nitrate, 2,2'-azobisisobutane, 2,2'-azobisisobutylamide, 2,2'-azobisisobutylonitrile, methyl 2,2'-azobis-2-methylpropionate, 2,2'-dichloro-2,2'-azobisbutane, 2,2'-azobis-2-methylbutylonitrile, dimethyl 2,2'-azobisisobutylate, 1,1'-azobis(sodium 1-methylbutylonitrile-3-sulfonate), 2-(4-methylphenylazo)-2-methylmalonodinitrile, 4,4'-azobis-4-cyanovaleric acid, 3,5-dihydroxymethylphenylazo-2-methylmalonodinitrile, 2-(4-boromophenylazo)-2-allylmalononitrile, 2,2'-azobis-2-methylvaleronitrile, dimethyl 4,4'-azobis-4-cyanovalarate, 2,2'-azobis-2,4-dimethylvaleronitrile, 1,1'-azobiscyclohexanenitrile, 2,2'-azobis-2-propylbutylonitrile, 1,1'-azobis-1-chlorophenylethane, 1,1'-azobis-1-cyclohexanecarbonitrile, 1,1'-azobis-1-cycloheptanenitrile, 1,1'-azobis-1-phenylethane, 1,1'-azobiscumene, ethyl 4-nitrophenylazobenzylcyanoacetate, phenylazodiphenylmethane, phenylazotriphenylmethane, 4-nitrophenylazotriphenylmethane, 1,1'-azobis-1,2-diphenylethane, poly(bisphenol A-4,4-azobis-4-cyanopentanoate) and poly(tetraethylene glycol-2,2'-azobisisobutylate); and (3) 1,4-Bis(pentaethylene)-2-tetrazene and 1,4-dimethoxycarbonyl -1,4-diphenyl-2-tetrazene.

The polymerization initiators may also be used as an initiator for the crosslinking reaction in the crosslinking step.

As the colorant used in the toner of the invention, at least one kind selected from a cyan pigment, a magenta pigment and a yellow pigment may be used. The pigments may be used singly or as a mixture of two or more pigments of the same series. Two or more pigments of different series may also be used as a mixture. Specific examples of the colorant include various pigments, such as Chrome Yellow, Hansa Yellow, Benzidine Yellow, Suren Yellow, Quinoline Yellow, Permanent Orange GTR, Pyrazolone Orange, Vulkan Orange, Watchyoung Red, Permanent Red, Brilliant Carmine 3B, Brilliant Carmine 6B, Du Pont Oil Red, Pyrazolone Red, Lithol Red, Rhodamine B Lake, Lake Red C, Rose Bengal, Aniline Blue, Ultramarine Blue, Calco Oil Blue, Methylen Blue Chloride, Phthalocyanine Blue, Phthalocyanine Green and Malachite Green Oxalate; and various dyes, such as acridine series, xanthene series, azo series, benzoquinone series, azine series, anthraquinone series, dioxane series, thiazine series, azomethine series, indigo series, thoindigo series, phthalocyanine series, aniline black series, polymethine series, triphenylmethane series, diphenylmethane series, thiazole series and xanthene series. A black pigment or a black dye, such as carbon black, may be added to the colorant in such an extent that the transparency is not impaired.

A releasing agent may be added to the toner of the invention depending on necessity.

Specific examples of the releasing agent include a low molecular weight polyolefin, such as polyethylene, polypropylene and polybutene; a silicone compound having a softening point upon heating; an aliphatic amide, such as oleic amide, erucic amide, recinoleic amide and stearic amid; vegetable wax, such as carnauba wax, rice wax, candelilla wax, Japan wax and jojoba oil; animal wax, such as yellow beeswax; and mineral and petroleum wax, such as montan wax, ozokerite, ceresin, paraffin wax, microcrystalline wax and Fischer-Tropsch wax. The releasing agents may be used singly or in combination of two or more of them.

The addition amount of the releasing agent is preferably in a range of from 0.5 to 50% by weight, more preferably from 1 to 30% by weight, and further preferably from 5 to 15% by weight. When the addition amount is less than 0.5% by weight, no effect of addition of the releasing agent is obtained. When it exceeds 50% by weight, the charging property is adversely affected, and the toner is liable to be broken in a developing unit to make the releasing agent be spent to the carrier, whereby not only adverse effects, such as decrease in charging, occur, but also in the case where a color toner is used, appearance on the image surface upon fixing is liable to be insufficient, and thus there is a possibility that the releasing agent remains in the image to deteriorate the transparency.

The ester compound used in the invention has an alkyl group having from 6 to 32 carbon atoms, and a compound having a molecular weight of about from 200 to 1,500 is suitably used. When the number of carbon atoms of the alkyl group is less than 5, the hydrophilicity of the ester compound becomes too high to make the ester compound be hydrophilic, and it is not dissolved in the crystalline resin. When the number of carbon atoms is 33 or more, it cannot migrate in the crystalline resin, and thus the dispersion stability of the aggregated particles cannot be ensured. When the molecular weight of the ester compound is less than 200, the particle size distribution of the aggregated particles is liable to be broadened since it is difficult to be compatible with the crystalline resin owing to the large difference in viscosity. When the molecular weight exceeds 1,500, an impurity, such as an isomer, is liable to be mixed in the ester compound, and it is not preferred since the controllability is decreased. A polymer having a large number of carbon atoms, such as polyester, is poor in orientation property and cannot be exhibit the addition effect of the ester compound of the invention. A preferred example of the ester compound of the invention is one having from 10 to 24 carbon atoms and a molecular weight in a range of from 300 to 700.

Specific examples of the ester compound used in the invention include the following. These compounds may be used singly or in combination of two or more of them.

(1) An ester of a higher fatty acid and a higher alcohol, such as stearyl stearate and behenyl behenate;

(2) An ester of a higher fatty acid and a monohydric or polyhydric lower alcohol, such as butyl stearate, propyl oleate, monostearic glyceride, distearic glyceride and pentaerythritol tetrabehenate;

(3) An ester of a higher fatty acid and a polyhydric alcohol, such as diethylene glycol monostearate, dipropylene glycol distearate, distearic diglyceride and tetrastearic triglyceride;

(4) A sorbitan higher fatty acid ester, such as sorbitan monostearate; and (5) A cholesterol higher fatty acid ester, such as cholesteryl stearate.

In the toner for developing an electrostatic latent image according to the invention, the resin having a contact angle with water that is smaller than the crystalline resin forms a difference in contact angle with water from the crystalline resin. The difference in contact angle with water between them is preferably about 3° or more, more preferably 5° or more, further preferably 10° or more, and particularly preferably 15° or more. In the case where the difference in contact angle with water is less than 3°, there are cases where the aggregation property of the crystalline resin is deteriorated upon production of the toner by the aggregation process.

The resin having a contact angle with water that is smaller than that of the crystalline resin preferably has a contact angle with water in the range of about from 30 to 120°, more preferably from 50 to 120°, and further preferably from 70 to 120°. When a resin having a contact angle with water of less than 30° is used, the charging property of the toner is liable to be affected by humidity, and thus there are cases where the environmental stability becomes poor. When a binding resin having a contact angle with water exceeding 120° is used, the adhesion property with paper upon fixing is deteriorated, and thus there are cases where a toner of poor fixing property is obtained. Similarly, the crystalline resin preferably has a contact angle with water within the ranges described in the foregoing.

The contact angle with water used herein is measured in the following manner. Powder of the resin to be measured is molded under pressure of about 20 ton/cm$^2$ for 30 seconds to produce a resin plate. Pure water is placed in a syringe, and a water droplet of a prescribed size is prepared. The resin plate is slowly lifted up until the resin plate is in contact with the water droplet, and after the contact, the resin plate is then taken down. A contact angle formed between the tangent line at an edge of the droplet and the surface of the resin plate is measured. The measured contact angle is designated as the contact angle with water referred herein. The measurement of the contact angle can be conducted by using a commercially available contact angle meter (Type CA-DTA, produced by Kyowa Interface Science Co., Ltd.).

When the resin having a contact angle with water that is smaller than that of the crystalline resin is a resin having a glass transition point that is lower than the melting point of the crystalline resin, a toner having good reproducibility is obtained because upon formation of the aggregated particles by the aggregation process, the viscosity of the particular resin is lowered at a temperature over the glass transition point to increase the aggregation force among the particles, and thus the stability, the particle size and the particle size distribution of the aggregated particles can be easily controlled.

Specific examples of the resin having a contact angle with water that is smaller than that of the crystalline resin include a homopolymer or a copolymer of a styrene compound, such as styrene, parachlorostyrene and α-methylstyrene (a styrene series resin); a homopolymer or a copolymer of an ester having a vinyl group, such as methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate and 2-ethylhexyl methacrylate (a vinyl series resin); a homopolymer or a copolymer of a vinyl nitrile, such as acrylonitrile and methacrylonitrile (a vinyl series resin); a homopolymer or a copolymer of a vinyl ether, such as vinyl methyl ether and vinyl isobutyl ether (a vinyl series resin); a homopolymer or a copolymer of a vinyl ketone, such as vinyl methyl ketone, vinyl ethyl ketone and vinyl isopropenyl ketone (a vinyl series resin); a homopolymer or a copolymer of an olefin, such as ethylene, propylene, butadiene and isoprene (an olefin series resin); a non-vinyl condensation resin, such as an epoxy resin, a polyester resin, a polyurethane resin, a polyamide resin, a cellulose resin and a polyether resin; and a graft polymer of the non-vinyl condensation resin and the vinyl series monomer. The resins may be used singly or in combination of two or more of them.

The proportion of the resin with respect to the crystalline resin is preferably from 1 to 50%, more preferably from 3 to 40%, and further preferably from 5 to 30%. When the proportion is less than 1%, there are cases where the hydrophilicity of the aggregated particles upon production of the toner by the aggregation process becomes insufficient, and it is not preferred since the stability is deteriorated. When it exceeds 50%, the effect of the crystalline resin upon fixing is difficult to be exhibited, and it is not preferred since there are cases where the low temperature fixing property is deteriorated.

In order to obtain high image quality, the volume average particle diameter of the toner of the invention is preferably adjusted to the range of from 3 to 10 μm. When it exceeds 10 μm, the reproducibility of thin lines in the developing step becomes poor, and thus the image quality is deteriorated. When it is lower than 3 μm, it is not preferred since the service life of the developer is shortened. The volume average particle diameter of the toner of the invention is more preferably in the range of from 4 to 7 μm.

Process for Producing Toner for Developing Electrostatic Latent Image

The toner for developing an electrostatic latent image according to the invention is preferably produced in the following aggregation and coalescence process. A resin is agitated and dispersed in a dispersion to prepare a resin particle dispersion, or in alternative, a resin particle dispersion is produced by emulsion polymerization. The resin particle dispersion is mixed with a dispersion of an aggregated particle stabilizer and dispersions of a pigment and a releasing agent to effect hetero aggregation, and then the crystalline resin is melted to integrate the particles to obtain toner particles. The colorant may be previously contained in the resin particles. This process is preferred from the standpoint of obtaining the foregoing effects. The toner for developing an electrostatic latent image according to the invention may also be produced by a dissolution and suspension process and a suspension polymerization process.

The aggregation and coalescence process of the invention contains a step of mixing at least a resin particle dispersion and a dispersion of an aggregated particle stabilizer, as well as, depending on necessity, a colorant dispersion and a releasing agent dispersion, so as to aggregate resin particles to form aggregated particles, whereby an aggregated particle dispersion is prepared (an aggregating step), and a step of heating the aggregated particles to form toner particles (a coalescing step).

In the aggregating step, the hetero aggregation is conducted to form the aggregated particles by adding an ionic surfactant having a polarity different from that of the aggregated particles and a compound having a charge of one or more valent, such as a metallic salt, so as to stabilize the aggregated particles and to control the particle size and the particle size distribution.

In the coalescing step, the aggregated particles is heated to a temperature higher than the melting point of the crystalline resin contained in the aggregated particles, so as to obtain the toner particles.

The coalesced particles obtained by coalescing in the coalescing step are present in an aqueous medium in the form of a colored particle dispersion. The dispersion is washed to remove the colored particles from the aqueous medium and to remove impurities formed in the respective steps, followed by drying, so as to obtain the toner particles.

In the washing step, acidic or basic washing water is added in an amount of several times the colored particles, and after agitation, a solid content is obtained by filtration. Pure water is added to the solid content in an amount of several times the solid content, and after agitation, filtration is conducted. The foregoing operation is repeated by several times until the pH of the filtrate after filtration becomes about 7 to obtain the colored particles.

In the drying step, the colored particles obtained in the washing step are dried at a temperature below the melting point of the colored particles. At this time, depending on necessity, dried air is circulated, or heating is effected under vacuum.

In order to stabilize the resin particle dispersion, the colorant dispersion and the releasing agent dispersion used in the invention, the resin particle dispersion of the invention can be used as it is. However, in the case where the colorant dispersion and the releasing agent dispersion are difficult to be dispersed as they are, or in the case where the stability of the resin particle dispersion is to be maintained with the lapse of time, a slight amount of a surfactant may be employed.

Examples of the surfactant include an anionic surfactant, such as a sulfate series, a sulfonate series, a phosphate series and a soap series; a cationic surfactant, such as an amine salt type and a quaternary ammonium salt type; and a nonionic surfactant, such as a polyethylene glycol series, an alkylphenol ethylene oxide adduct series and a polyhydric alcohol series. Among these, an ionic surfactant is preferred, and an anionic surfactant and a cationic surfactant are more preferred.

In the production process of the toner of the invention, a cationic surfactant is advantageous as a surfactant for dispersing the releasing agent because an anionic surfactant generally has a high dispersion power and is excellent in dispersion of the resin particles and the colorant.

A nonionic surfactant is preferably used in combination with the anionic surfactant or the cationic surfactant. The foregoing surfactants may be used singly or in combination of two or more of them. Specific examples of the anionic surfactant include a fatty acid soap, such as potassium laurate, sodium oleate and sodium castor oil; a sulfate, such as octyl sulfate, lauryl sulfate, lauryl ether sulfate and nonyl phenyl ether sulfate; a sulfonate, lauryl sulfonate, dodecylbenzene sulfonate, a sodium alkylnaphthalene sulfonate, e.g., triisopropylnaphthalene sulfonate and dibutylnaphthalene sulfonate, a naphthalene sulfonate formalin condensate, monooctyl sulfosuccinate, dioctyl sulfosuccinate, lauric amide sulfonate and oleic amide sulfonate; a phosphate, such as lauryl phosphate, isopropyl phosphate and nonyl phenyl ether phosphate; a dialkyl sulfosuccinate, such as sodium dioctyl sulfosuccinate; and a sulfosuccinate, such as disodium lauryl sulfosuccinate.

Specific examples of the cationic surfactant include an amine salt, such as laurylamine hydrochloride, stearylamine hydrochloride, oleylamine acetate, stearylamine acetate and stearylaminopropylamine acetate; and a quaternary ammonium salt, such as lauryltrimethylammonium chloride, dilauryldimethylammonium chloride, distearylammonium chloride, distearyldimethylammonium chloride, lauryldihydroxyethylmethylammonium chloride, oleylbispolyoxyethylenemethylammonium chloride, lauroylaminopropyldimethylethylammonium ethosulfate, lauroylaminopropyldimethylhydroxyethylammonium perchlorate, alkylbenzenedimethylammonium chloride and alkyltrimethylammonium chloride.

Specific examples of the nonionic surfactant include an alkyl ether, such as polyoxyethylene octyl ether, polyoxyethylene lauryl ether, polyoxyethylene stearyl ether and polyoxyethylene oleyl ether; an alkyl phenyl ether, such as polyoxyethylene octyl phenyl ether and polyoxyethylene nonyl phenyl ether; an alkyl ester, such as polyoxyethylene laurate, polyoxyethylene stearate and polyoxyethylene oleate; an alkyl amine, such as polyoxyethylene laurylamino ether, polyoxyethylene stearylamino ether, polyoxyethylene oleylamino ether, polyoxyethylene soy bean amino ether and polyoxyethylene beef tallow amino ether; an alkyl amide, such as polyoxyethylene lauric amide, polyoxyethylene stearic amide and polyoxyethylene oleic amide; a vegetable oil ether, such as polyoxyethylene castor oil ether and polyoxyethylene colza oil ether; an alkanol amide, such as lauric diethanol amide, stearic diethanol amide and oleic diethanol amide; and a sorbitan ester ether, such as polyoxyethylene sorbitan monolaurate, polyoxyethylene sorbitan monoparmitate, polyoxyethylene sorbitan monostearate and polyoxyethylene sorbitan monooleate.

The content of the surfactant in the dispersion may be such an extent that does not impair the invention, and is generally a small amount. Specifically, in the case of the resin particle dispersion, it is suitably in the range of from 0.01 to 1% by weight, preferably from 0.02 to 0.5% by weight, and more preferably from 0.1 to 0.2% by weight. When the content of the surfactant is less than 0.01% by weight, there are cases where aggregation occurs particularly in the case where the pH of the resin particles dispersion is not sufficiently basic.

The content of the surfactant in the colorant dispersion and the releasing agent dispersion is suitably in the range of from 0.01 to 10% by weight, preferably from 0.1 to 5% by weight, and more preferably from 0.5 to 2% by weight. When the content of the surfactant is less than 0.01% by weight, scattering occurs in the stability among the particles upon aggregation to cause a problem of isolation of particular particles. When it exceeds 10% by weight, the particle size distribution is broadened, and the particle diameter is difficult to be controlled. Therefore, both the cases are not preferred.

To the toner of the invention, particles of other components, such as an internal additive, a charge controlling agent, inorganic particles, organic particles, a lubricant and an abrasive, may be added, in addition to the binder resin, the colorant and the releasing agent, depending on necessity.

The internal additive may be used as far as it does not impair the charging property of the toner characteristics, and examples of which include a metal, an alloy and a compound containing a metal, such as ferrite, magnetite, reduced iron, cobalt, manganese and nickel.

The charge controlling agent is not particularly limited, and in the case where it is used in a color toner, colorless or leucocratic ones are preferred. Examples thereof include a quaternary ammonium salt compound, nigrosine series compound, a dye containing a complex of aluminum, iron or chromium, and a triphenylmethane series pigment.

Examples of the inorganic particles include all particles that are ordinarily used as an external additive to the toner surface, such as silica, titania, calcium carbonate, magnesium carbonate, tricalcium phosphate and cerium oxide.

Examples of the organic particles include particles that are ordinarily used as an external additive to the toner surface, such as a vinyl series resin, a polyester resin and a silicone resin. The inorganic particles and the organic particles may also be used as a fluidity assistant and a cleaning assistant.

Examples of the lubricant include a fatty acid amide, such as ethylenebisstearic amide and oleic amide, and fatty acid metallic salt, such as zinc stearate and calcium stearate.

Examples of the abrasive include silica, alumina and cerium oxide described in the foregoing.

Upon mixing the binder resin, the colorant and the releasing agent, the content of the colorant in the toner may be 50% by weight or less, and preferably in the range of from 2 to 40% by weight.

The contents of the other components may be such an extent that does not impair the effect of the invention, and are generally slight amounts. Specifically, it is generally in the range of from 0.01 to 5% by weight, and preferably from 0.5 to 2% by weight.

An aqueous medium, for example, is used as the dispersion medium of the resin particle dispersion, the colorant dispersion, the releasing agent dispersion and other component dispersions of the invention.

Examples of the aqueous medium include water, such as distilled water and ion exchanged water, and an alcohol. These may be used singly or in combination of two or more of them.

In the preparation step of the aggregated particle dispersion in the invention, it is preferred to add an aggregating agent, so as to accelerate and stabilize the aggregation of the particles, and to obtain the aggregated particles having a narrower particle size distribution.

As the aggregating agent, a compound having one or more valent charge is preferred, and specific examples thereof include a water soluble surfactant, such as an ionic surfactant and a nonionic surfactant; an acid, such as hydrochloric acid, sulfuric acid, nitric acid, acetic acid and oxalic acid; a metallic salt of an inorganic acid, such as magnesium chloride, sodium chloride, aluminum sulfate, calcium sulfate, ammonium sulfate, aluminum nitrate, silver nitrate, copper sulfate and sodium carbonate; a metallic salt of a fatty acid or an aromatic acid, such as sodium acetate, potassium formate, sodium oxalate, sodium phthalate and potassium salicylate; a metallic salt of a phenol, such as sodium phenolate; a metallic salt of an amino acid; and an inorganic acid salt of a fatty or aromatic amine, such as triethanolamine hydrochlorate and aniline hydrochlorate.

A metallic salt of an inorganic acid is preferred from the standpoint of performance and use with consideration of the stability of the aggregated particles, the thermal stability and the time-lapse stability of the aggregating agent, and the removal of the aggregating agent upon washing.

The addition amount of the aggregating agent may be a small amount, while depending on the valence number of charge, and may be 3% by weight or less for monovalence, 1% by weight or less for divalence, and 0.5% by weight or less for trivalence. Since it is preferred that the amount of the aggregated agent is as small as possible, a compound having a larger valence is preferred.

The surface area of the toner for developing an electrostatic latent image according to the invention is not particularly limited, and no problem occurs when it is in the range that is generally used in a toner. Specifically, the surface area measured by the BET method is suitably from 0.5 to 10 $m^2/g$, preferably from 1.0 to 7 $m^2/g$, and more preferably from 1.2 to 5 $m^2/g$.

Inorganic particles, such as silica, alumina, titania and calcium carbonate, and resin particles, such as a vinyl series resin, a polyester resin and silicone resin, may be added to the surface of the toner for developing an electrostatic latent image according to the invention by mixing under application of a shearing force in a dry state. The inorganic particles and the resin particles function as a fluidity assistant or a cleaning assistant.

The absolute value of the charge amount of the toner for developing an electrostatic latent image is suitably in the range of from 10 to 40 $\mu$C/g, and preferably from 15 to 35 $\mu$C/g. When the absolute value of the charge amount is less than 10 $\mu$C/g, background stain is liable to occur, and when it exceeds 40 $\mu$C/g, decrease in image density is liable to occur.

The ratio of the charge amount in the summer season and the charge amount in the winter season of the toner for developing an electrostatic latent image is suitably in the range of from 0.5 to 1.5, and preferably from 0.7 to 1.3. When the ratio is outside the range, it is not preferred from the practical standpoint since the environmental dependency of the toner becomes large to lack the stability in charging.

Developer for Developing Electrostatic Latent Image

The developer for developing an electrostatic latent image according to the invention is not particularly limited except that the toner for developing an electrostatic latent image according to the invention is contained, and an appropriate component composition may be employed depending on purpose.

The developer for developing an electrostatic latent image according to the invention may be prepared as a one-component developer using the toner for developing an electrostatic latent image solely, or as a two-component developer using the toner and a carrier in combination.

The carrier is not particularly limited, and the known carriers may be employed. For example, the known carrier, such as the resin coated carriers described in Japanese Patent Laid-Open Nos.39879/1987 and 11461/1981 may be used.

Specific examples of the carrier include the following resin coated carriers. Examples of core particles of the carrier include ordinary iron powder, and molded particles of ferrite and magnetite, and the average particle diameter thereof is about from 30 to 200 $\mu$m.

Examples of the resin coated on the core particles include a homopolymer of a monomer or a copolymer formed from two or more monomers, such as a styrene compound, such as styrene, p-chlorostyrene and $\alpha$-methylstyrene, an $\alpha$-methylene fatty acid monocarboxylate, such as methyl acrylate, ethyl acrylate, n-propyl acrylate, lauryl acrylate, 2-ethylhexyl acrylate, methyl methacrylate, n-propyl methacrylate, lauryl methacrylate and 2-ethylhexyl methacrylate, a nitrogen-containing acrylic compound, such as dimethylaminoethyl methacrylate, a vinyl nitrile, such as acrylonitrile and methacrylonitrile, a vinylpyridine, such as 2-vinylpyridine and 4-vinylpyridine, a vinyl ether, such as vinyl methyl ether and vinyl isobutyl ether, a vinyl ketone, such as vinyl methyl ketone, vinyl ethyl ketone and vinyl isopropenyl ketone, an olefin, such as ethylene and propylene, and a vinyl series fluorine-containing monomer, such as vinylidene fluoride, tetrafluoroethylene and hexafluoropropylene; a silicone, such as methylsilicone and methylphenylsilicone; a polyester containing bisphenol and glycol; an epoxy resin; a polyurethane resin; a polyamide resin; a cellulose resin; a polyether resin; and a polycarbonate resin. These resins may be used singly or in combination of two or more of them. The amount of the coated resin is suitably in the range of from 0.1 to 10 parts by weight based on the core particles, and preferably from 0.5 to 3.0 parts by weight.

In the production of the carrier, a heating kneader, a heating Henschel mixer and an UM mixer may be used, and a heating fluidized rolling bed and a heating kiln may also be used depending on the amount of the coating resin.

The mixing ratio of the toner and the carrier in the developer for developing an electrostatic latent image is not particularly limited and may be appropriately selected depending on purpose.

Process for Forming Image

The process for forming an image according to the invention contains the step of forming an electrostatic latent image, the step of forming a toner image, the transferring step and the fixing step. The respective steps for forming an image are ordinary processes and described, for example, in Japanese Patent Laid-Open Nos. 40868/1981 and 91231/1974, and they can be applied to a known apparatus for forming an image, such as a duplicator and a facsimile machine.

In the formation of an electrostatic latent image, an electrostatic latent image is formed on an electrostatic latent image holding member. In the formation of a toner image, the electrostatic latent image is developed with a developer layer on a developer holding member to form a toner image. The developer layer is not particularly limited as far as it contains the developer for developing an electrostatic latent image according to the invention. In the transferring step, the toner image is transferred to a fixing substrate. In the fixing step, the toner image transferred to the fixing substrate is fixed on the fixing substrate, such as paper by heating with a fixing member.

The characteristic features of the process for forming an image according to the invention are that the fixing temperature of a belt type fixing unit and a roll type fixing unit can be low by using the toner for developing an electrostatic latent image according to the invention, excellent in low temperature fixing property, so as to enable high speed fixing, and an energy saving effect and an effect of shortening the warm-up time can be obtained. Particularly, in the process for forming an image employing a belt type fixing unit having low heating performance for fixing, it is advantageous since good image quality can be obtained without forming background fogging and cold offset.

Apparatus for Forming Image

An example of an apparatus for forming an image according to the invention is shown in FIG. 1. The apparatus contains a photoreceptor drum 1 having around the same in the rotation direction a charging device 2, an image writing unit 3 , such as laser light, a developing device 4, a primary transferring unit 5 and a cleaning unit 6, and toners of respective colors, i.e., black, yellow, magenta and cyan, are installed in developing units $\mathbf{4}_1$ to $\mathbf{4}_4$ of the developing device 4, respectively. An intermediate transfer belt 7, which is in contact with the surface of the photoreceptor drum 1 and runs between the photoreceptor drum 1 and the primary transferring unit 5 in the direction shown by the arrow, is hung by tension rolls 8*a*, 8*b* and 8*c* and a backup roll 9. A bias roll 10 and a belt cleaner 11 are arranged to face the backup roll 9 and the tension roll 8*a*, respectively.

A part where the primary transferring unit 5 pushes the photoreceptor drum 1 through the intermediate transfer belt 7 is a primary transferring part, and a part where the bias roll 10 pushes the backup roll 9 is a secondary transferring part. A toner image is transferred from the intermediate transfer belt 7 to transfer paper P supplied from a paper supplying tray 13 to the secondary transferring part, and then the transfer paper P is transported to and fixed by a fixing unit 14 containing a pressure roll 15 having a heater inside and a transfer belt 16. A pressure pad 17 for pushing the transfer belt 16 onto the pressure roll 15 and a belt guide 18 are arranged inside the transfer belt 16.

The invention will be described in more detail with reference to the following examples, but the invention is not construed as being limited thereto.

All the "parts" referred below are parts by weight. The average particle diameter of the toner is measured by a Coulter Counter (Type TA2, produced by Beckman Coulter, Inc.). The particle size distribution of the toner, which is represented by GSDv, is a square root of $d_{50}/d_{16}$, which is obtained by dividing the particle diameter $d_{50}$, at which the accumulated volume diameter from the small diameter side becomes 50%, by the particle diameter $d_{16}$, at which the accumulated volume diameter from the small diameter side becomes 16%. The melting point of the resin constituting the toner particles is measured by using a differential scanning calorimeter (DSC-50, produced by Shimadzu Corp.) under the condition of a temperature increasing rate of 3° C. per minute.

The tangent loss (tan δ) is measured by using a viscoelasticity measuring apparatus (ARES, produced by Rheometric Scientific FE, Inc.) in the following manner. The toner for developing an electrostatic latent image is molded into a tablet and set between parallel plates having a distance of 8 mm, and after setting the normal force at 0, vibration of a frequency of 1 rad/sec is applied thereto. The measurement temperature is started at 40° C. and is continued until 200° C. The measurement is conducted with a measurement interval of 120 seconds and a temperature increasing rate after starting the measurement of 1° C. per minute. The distortion amount is maintained at a suitable value for each measuring temperature during the measurement, so as to appropriately adjust to obtain adequate measurement values. The storage elastic modulus GL and the loss elastic modulus GN are measured in such a manner that GL and GN with respect to the temperature is monitored every two minutes by using the viscoelasticity measuring apparatus (ARES, produced by Rheometric Scientific FE, Inc.).

| Preparation of Resin Particle Dispersion (1) | |
|---|---|
| Sebacic acid | 789.0 parts |
| Ethylene glycol | 310.5 parts |
| Sodium isophthalate-5-sulfonate | 199.7 parts |
| Fumaric acid | 40.7 parts |
| Dibutyl tin | 2.0 parts |
| (all produced by Wako Pure Chemical Industries, Ltd.) | |

The foregoing components are mixed in a flask and heated to 240° C. under reduced pressure to conduct dehydration condensation for 6 hours, so as to obtain a resin. After cooling, 150 parts of the resin are put in 850 parts of distilled water and mixed by agitation with a homogenizer (Ultra-Turrax, produced by IKA Japan Co., Ltd.) under heating to 85° C., followed by cooling to room temperature to obtain a resin particle dispersion (1). The resulting resin particles have a melting point of 71° C.

| Preparation of Resin Particle Dispersion (2) | |
|---|---|
| Succinic acid | 769.8 parts |
| Butanediol | 450.5 parts |
| Sodium isophthalate-5-sulfonate | 199.7 parts |
| Fumaric acid | 40.7 parts |
| Dibutyl tin | 2.5 parts |
| (all produced by Wako Pure Chemical Industries, Ltd.) | |

The foregoing components are subjected to dehydration condensation and mixed by agitation under the same conditions as in the preparation of the resin particle dispersion (1), so as to obtain a resin particle dispersion (2). The resulting resin particles have a melting point of 90° C.

| Preparation of Resin Particle Dispersion (3) | |
|---|---|
| Azelaic acid | 734.0 parts |
| Butanediol | 450.5 parts |
| Sodium isophthalate-5-sulfonate | 199.7 parts |
| Fumaric acid | 40.7 parts |
| Dibutyl tin | 2.0 parts |
| (all produced by Wako Pure Chemical Industries, Ltd.) | |

The foregoing components are subjected to dehydration condensation and mixed by agitation under the same conditions as in the preparation of the resin particle dispersion (1), so as to obtain a resin particle dispersion (3). The resulting resin particles have a melting point of 49° C.

| Preparation of Resin Particle Dispersion (4) | |
|---|---|
| Terephthalic acid | 647.8 parts |
| Decanediol | 871.5 parts |
| Sodium isophthalate-5-sulfonate | 199.7 parts |
| Fumaric acid | 40.7 parts |
| Dibutyl tin | 2.0 parts |
| (all produced by Wako Pure Chemical Industries, Ltd.) | |

The foregoing components are subjected to dehydration condensation and mixed by agitation under the same conditions as in the preparation of the resin particle dispersion (1), so as to obtain a resin particle dispersion (4). The resulting resin particles have a melting point of 86° C.

| Preparation of Resin Particle Dispersion (5) | |
|---|---|
| Sebacic acid | 734.0 parts |
| Ethylene glycol | 450.5 parts |
| Sodium isophthalate-5-sulfonate | 199.7 parts |
| Fumaric acid | 40.7 parts |
| Dibutyl tin | 2.0 parts |
| (all produced by Wako Pure Chemical Industries, Ltd.) | |

The foregoing components are subjected to dehydration condensation and mixed by agitation under the same conditions as in the preparation of the resin particle dispersion (1), so as to obtain a resin particle dispersion (5). The resulting resin particles have a melting point of 70° C.

| Preparation of Resin Particle Dispersion (6) | |
|---|---|
| Styrene | 200 parts |
| Stearyl acrylate | 800 parts |
| Sodium P-styrene sulfonate | 50 parts |
| Dodecylmercaptan | 30 parts |
| (all produced by Wako Pure Chemical Industries, Ltd.) | |
| Decanediol diacrylate | 4 parts |
| (produced by Shin-Nakamura Chemical Co., Ltd.) | |

A solution obtained by mixing and dissolving the foregoing components is dispersed and emulsified in a solution obtained by dissolving 20 parts of an anionic surfactant (Newlex Paste H, produced by NOF Corp.) in 1,300 parts of ion exchanged water in a flask. The dispersion is slowly mixed over 10 minutes, and 200 parts of ion exchanged water having 20 parts of ammonium persulfate (produced by Wako Pure Chemical Industries, Ltd.) dissolved therein is put therein. After conducting substitution with nitrogen, the content of the flask is heated over an oil bath until the content reaches 70° C. under stirring, and emulsion polymerization is continued under the same conditions for 6 hours. Thereafter, the reaction mixture is cooled to room temperature to obtain a resin particle dispersion (6). The resulting resin particles have a melting point of 66° C.

| Preparation of Colorant Dispersion (1) | |
|---|---|
| Phthalocyanine pigment | 250 parts |
| (PV Fast Blue, produced by Dainichiseika Colour & Chemicals Mfg. Co., Ltd.) | |
| Anionic surfactant | 20 parts |
| (Neogen RK, produced by Dai-ichi Kogyo Seiyaku Co., Ltd.) | |
| Ion exchanged water | 730 parts |

The foregoing components are mixed and dissolved, and the mixture is dispersed by using a homogenizer (Ultra-Turrax, produced by IKA Corp.), so as to obtain a colorant dispersion (1) having a colorant (phthalocyanine pigment) dispersed therein.

| Preparation of Colorant Dispersion (2) | |
|---|---|
| Yellow pigment | 200 parts |
| (C.I.PY180, produced by Clariant Japan Co., Ltd.) | |
| Anionic surfactant | 20 parts |
| (Newlex R, produced by NOF Corp.) | |
| Ion exchanged water | 780 parts |

The foregoing components are mixed and dissolved, and the mixture is dispersed by using a homogenizer (Ultra-Turrax, produced by IKA Corp.), so as to obtain a colorant dispersion (2) having a colorant (yellow pigment) dispersed therein.

| Preparation of Colorant Dispersion (3) | |
|---|---|
| Magenta pigment | 300 parts |
| (C.I.PR122, produced by Dainichiseika Colour & Chemicals Mfg. Co., Ltd.) | |
| Anionic surfactant | 25 parts |
| (Newlex R, produced by NOF Corp.) | |
| Ion exchanged water | 675 parts |

The foregoing components are mixed and dissolved, and the mixture is dispersed by using a homogenizer (Ultra-Turrax, produced by IKA Corp.), so as to obtain a colorant dispersion (3) having a colorant (magenta pigment) dispersed therein.

| Preparation of Colorant Dispersion (4) | |
|---|---|
| Carbon black | 230 parts |
| (Regal 330, produced by Cabot Inc.) | |
| Anionic surfactant | 25 parts |
| (Newlex R, produced by NOF Corp.) | |
| Ion exchanged water | 745 parts |

The foregoing components are mixed and dissolved, and the mixture is dispersed by using a homogenizer (Ultra-Turrax, produced by IKA Corp.), so as to obtain a colorant dispersion (4) having a colorant (carbon black) dispersed therein.

| Preparation of Releasing Agent Particle Dispersion | |
|---|---|
| Polyethylene wax (molecular weight: 730) (Polywax 725, produced by Toyo Petrolite Co., Ltd.) | 400 parts |
| Anionic surfactant (Newlex R, produced by NOF Corp.) | 20 parts |
| Ion exchanged water | 580 parts |

The foregoing components are dissolved by mixing, and the mixture is dispersed by using a homogenizer (Ultra-Turrax, produced by IKA Corp.), followed by subjecting to a dispersion treatment by a pressure discharge type homogenizer, so as to obtain a releasing agent particle dispersion having releasing agent particle (polyethylene wax) dispersed therein. The releasing agent particle dispersion is dried, and the measurement of the softening point of the remaining releasing agent reveals 98° C.

| Preparation of Ester Compound Particle Dispersion (1) | |
|---|---|
| Stearyl stearate (Rikemal SL-800, produced by Riken Vitamin Co., Ltd.) (Carbon number of alkyl group of ester compound: 17) (Molecular weight: 522) | 100 parts |
| Anionic surfactant (Newlex R, produced by NOF Corp.) | 2 parts |
| Ion exchanged water | 300 parts |

The foregoing components are dissolved by mixing, and the mixture is dispersed by using a homogenizer (Ultra-Turrax, produced by IKA Corp.), followed by subjecting to a dispersion treatment by a pressure discharge type homogenizer, so as to obtain an ester compound particle dispersion (1) having an ester compound particle dispersed therein.

| Preparation of Ester Compound Particle Dispersion (2) | |
|---|---|
| Butyl stearate (NIKKO LBS, produced by Nikko Chemicals Co., Ltd.) (Carbon number of alkyl group of ester compound: 17) (Molecular weight: 354) | 100 parts |
| Anionic surfactant (Newlex R, produced by NOF Corp.) | 2 parts |
| Ion exchanged water | 300 parts |

The foregoing components are dissolved by mixing, and the mixture is dispersed by using a homogenizer (Ultra-Turrax, produced by IKA Corp.), followed by subjecting to a dispersion treatment by a pressure discharge type homogenizer, so as to obtain an ester compound particle dispersion (2) having an ester compound particle dispersed therein.

| Preparation of Ester Compound Particle Dispersion (3) | |
|---|---|
| Butyl laurate (produced by NOF Corp.) (Carbon number of alkyl group of ester compound: 11) (Molecular weight: 256) | 100 parts |
| Anionic surfactant (Newlex R, produced by NOF Corp.) | 2 parts |
| Ion exchanged water | 300 parts |

The foregoing components are dissolved by mixing, and the mixture is dispersed by using a homogenizer (Ultra-Turrax, produced by IKA Corp.), followed by subjecting to a dispersion treatment by a pressure discharge type homogenizer, so as to obtain an ester compound particle dispersion (3) having an ester compound particle dispersed therein.

| Preparation of Ester Compound Particle Dispersion (4) | |
|---|---|
| Glycerin mono/dibehenate (Rikemal B-200, produced by Riken Vitamin Co., Ltd.) (Carbon number of alkyl group of ester compound: 21) (Molecular weight: 617) | 100 parts |
| Anionic surfactant (Newlex R, produced by NOF Corp.) | 2 parts |
| Ion exchanged water | 300 parts |

The foregoing components are dissolved by mixing, and the mixture is dispersed by using a homogenizer (Ultra-Turrax, produced by IKA Corp.), followed by subjecting to a dispersion treatment by a pressure discharge type homogenizer, so as to obtain an ester compound particle dispersion (4) having an ester compound particle dispersed therein.

| Preparation of Ester Compound Particle Dispersion (5) | |
|---|---|
| Sorbitan monostearate (Emalex SPE-100, produced by Nippon Nyukazai Co., Ltd.) (Carbon number of alkyl group of ester compound: 17) (Molecular weight: 431) | 100 parts |
| Anionic surfactant (Newlex R, produced by NOF Corp.) | 2 parts |
| Ion exchanged water | 300 parts |

The foregoing components are dissolved by mixing, and the mixture is dispersed by using a homogenizer (Ultra-Turrax, produced by IKA Corp.), followed by subjecting to a dispersion treatment by a pressure discharge type homogenizer, so as to obtain an ester compound particle dispersion (5) having an ester compound particle dispersed therein.

| Preparation of Ester Compound Particle Dispersion (6) | |
|---|---|
| Cholesteryl stearate (produced by Nikko Chemicals Co., Ltd.) (Carbon number of alkyl group of ester compound: 17) (Molecular weight: 649) | 100 parts |
| Anionic surfactant (Newlex R, produced by NOF Corp.) | 2 parts |
| Ion exchanged water | 300 parts |

The foregoing components are dissolved by mixing, and the mixture is dispersed by using a homogenizer (Ultra-Turrax, produced by IKA Corp.), followed by subjecting to a dispersion treatment by a pressure discharge type homogenizer, so as to obtain an ester compound particle dispersion (6) having an ester compound particle dispersed therein.

| Preparation of Ester Compound Particle Dispersion (7) | |
|---|---|
| n-Amyl n-valerate<br>(produced by Wako Pure Chemical Industries, Ltd.)<br>(Carbon number of alkyl group of ester compound: 5)<br>(Molecular weight: 172) | 100 parts |
| Anionic surfactant<br>(Newlex R, produced by NOF Corp.) | 2 parts |
| Ion exchanged water | 300 parts |

The foregoing components are dissolved by mixing, and the mixture is dispersed by using a homogenizer (Ultra-Turrax, produced by IKA Corp.), followed by subjecting to a dispersion treatment by a pressure discharge type homogenizer, so as to obtain an ester compound particle dispersion (7) having an ester compound particle dispersed therein.

Production Example of Developer for Developing Electrostatic Latent Image (1)

(Aggregation Step)

| Preparation of Aggregated Particles | |
|---|---|
| Resin particle dispersion (1) | 2,833 parts |
| Colorant dispersion (1) | 100 parts |
| Releasing agent particle dispersion | 125 parts |
| Ester compound particle dispersion (1) | 200 parts |
| Lauroyl peroxide | 10 parts |
| Aluminum sulfate<br>(produced by Wako Pure Chemical Industries, Ltd.) | 5 parts |
| Ion exchanged water | 100 parts |

The foregoing components are placed in a round flask made of stainless steel and adjusted to pH 2.2. The contents of the flask are dispersed by using a homogenizer (Ultra-Turrax T50, produced by IKA Corp.) and heated over an oil bath for heating to 62° C. under stirring. After maintaining at 62° C. for 60 minutes, the observation by an optical microscope confirms that aggregated particles having an average particle diameter of about 4.8 μm are formed. After further maintaining at 62° C. for 30 minutes, the observation by an optical microscope confirms that aggregated particles having an average particle diameter of about 5.4 μm are formed.

(Coalescing Step)

The aggregated particle dispersion has pH of 2.2. An aqueous solution obtained by diluting sodium carbonate (produced by Wako Pure Chemical Industries, Ltd.) to 0.5% by weight is gradually added thereto to adjust the pH to 5.5, and the mixture is then heated to 90° C. under continuous stirring, followed by maintaining for 3 hours.

Thereafter, the reaction product is filtered and sufficiently washed with ion exchanged water, followed by drying by using a vacuum dryer, so as to obtain toner particles.

(Evaluation)

The resulting toner particles have an average particle diameter of 5.2 μm. 1 Part of colloidal silica (R972, produced by Nippon Aerosil Co., Ltd.) is mixed with and externally added to 100 parts of the toner particles by using a Henschel mixer to obtain a toner for developing an electrostatic latent image.

Preparation of Developer for Developing Electrostatic Latent Image

100 Parts of ferrite particles (produced by Powder Tech Co., Ltd., average particle diameter: 50 μm) and 2.5 parts of a methacrylate resin (produced by Mitsubishi Rayon Co., Ltd., molecular weight: 95,000) are placed in a pressure kneader along with 500 parts of toluene, and mixed by stirring at ordinary temperature for 15 minutes. Thereafter, the temperature is increased to 70° C. with mixing under reduced pressure, and after distilling off the toluene and cooling, classification is conducted by using a sieve of 105 μm to produce a ferrite carrier (resin coated carrier).

The ferrite carrier is mixed with the toner for developing an electrostatic latent image to produce a two-component developer for developing an electrostatic latent image (1) having a toner concentration of 7% by weight.

Production Example of Developer for Developing Electrostatic Latent Image (2)

(Aggregation Step)

| Preparation of Aggregated Particles | |
|---|---|
| Resin particle dispersion (2) | 2,833 parts |
| Colorant dispersion (1) | 100 parts |
| Releasing agent particle dispersion | 125 parts |
| Ester compound particle dispersion (1) | 200 parts |
| Lauroyl peroxide | 10 parts |
| Aluminum sulfate<br>(produced by Wako Pure Chemical Industries, Ltd.) | 5 parts |
| Ion exchanged water | 100 parts |

The foregoing components are placed in a round flask made of stainless steel and adjusted to pH 2.0. The contents of the flask are dispersed by using a homogenizer (Ultra-Turrax T50, produced by IKA Corp.) and heated over an oil bath for heating to 82° C. under stirring. After maintaining at 82° C. for 90 minutes, the observation by an optical microscope confirms that aggregated particles having an average particle diameter of about 5.6 μm are formed. After further maintaining at 82° C. for 60 minutes, the observation by an optical microscope confirms that aggregated particles having an average particle diameter of about 5.9 μm are formed.

(Coalescing Step)

The aggregated particle dispersion has pH of 2.1. An aqueous solution obtained by diluting sodium carbonate (produced by Wako Pure Chemical Industries, Ltd.) to 0.5% by weight is gradually added thereto to adjust the pH to 6.0, and the mixture is then heated to 97° C. under continuous stirring, followed by maintaining for 5 hours.

Thereafter, the reaction product is filtered and sufficiently washed with ion exchanged water, followed by drying by using a vacuum dryer, so as to obtain toner particles.

(Evaluation)

The resulting toner particles have an average particle diameter of 5.7 μm. A developer for developing an electrostatic latent image (2) is prepared by using the resulting toner particles in the same manner as in the preparation of the developer for developing an electrostatic latent image (1).

Production Example of Developer for Developing Electrostatic Latent Image (3)

(Aggregation Step)

| Preparation of Aggregated Particles | |
|---|---|
| Resin particle dispersion (3) | 2,833 parts |
| Colorant dispersion (1) | 100 parts |
| Releasing agent particle dispersion | 125 parts |
| Ester compound particle dispersion (1) | 200 parts |

-continued

| Preparation of Aggregated Particles | |
|---|---|
| Lauroyl peroxide | 12 parts |
| Aluminum sulfate (produced by Wako Pure Chemical Industries, Ltd.) | 5 parts |
| Ion exchanged water | 100 parts |

The foregoing components are placed in a round flask made of stainless steel and adjusted to pH 2.0. The contents of the flask are dispersed by using a homogenizer (Ultra-Turrax T50, produced by IKA Corp.) and heated over an oil bath for heating to 46° C. under stirring. After maintaining at 46° C. for 60 minutes, the observation by an optical microscope confirms that aggregated particles having an average particle diameter of about 4.4 μm are formed. After farther maintaining at 46° C. for 60 minutes, the observation by an optical microscope confirms that aggregated particles having an average particle diameter of about 4.5 μm are formed.

(Coalescing Step)

The aggregated particle dispersion has pH of 2.2. An aqueous solution obtained by diluting sodium carbonate (produced by Wako Pure Chemical Industries, Ltd.) to 0.5% by weight is gradually added thereto to adjust the pH to 5.2, and the mixture is then heated to 75° C. under continuous stirring, followed by maintaining for 4 hours.

Thereafter, the reaction product is filtered and sufficiently washed with ion exchanged water, followed by drying by using a vacuum dryer, so as to obtain toner particles.

(Evaluation)

The resulting toner particles have an average particle diameter of 4.7 μm. A developer for developing an electrostatic latent image (3) is prepared by using the resulting toner particles in the same manner as in the preparation of the developer for developing an electrostatic latent image (1).

Production Example of Developer for Developing Electrostatic Latent Image (4)

(Aggregation Step)

| Preparation of Aggregated Particles | |
|---|---|
| Resin particle dispersion (4) | 2,833 parts |
| Colorant dispersion (1) | 100 parts |
| Releasing agent particle dispersion | 125 parts |
| Ester compound particle dispersion (1) | 200 parts |
| Lauroyl peroxide | 10 parts |
| Aluminum sulfate (produced by Wako Pure Chemical Industries, Ltd.) | 5 parts |
| Ion exchanged water | 100 parts |

The foregoing components are placed in a round flask made of stainless steel and adjusted to pH 2.0. The contents of the flask are dispersed by using a homogenizer (Ultra-Turrax T50, produced by IKA Corp.) and heated over an oil bath for heating to 86° C. under stirring. After maintaining at 86° C. for 80 minutes, the observation by an optical microscope confirms that aggregated particles having an average particle diameter of about 6.2 μm are formed. After further maintaining at 86° C. for 90 minutes, the observation by an optical microscope confirms that aggregated particles having an average particle diameter of about 6.5 μm are formed.

(Coalescing Step)

The aggregated particle dispersion has pH of 2.2. An aqueous solution obtained by diluting sodium carbonate (produced by Wako Pure Chemical Industries, Ltd.) to 0.5% by weight is gradually added thereto to adjust the pH to 6.2, and the mixture is then heated to 95° C. under continuous stirring, followed by maintaining for 5 hours.

Thereafter, the reaction product is filtered and sufficiently washed with ion exchanged water, followed by drying by using a vacuum dryer, so as to obtain toner particles.

(Evaluation)

The resulting toner particles have an average particle diameter of 6.6 μm. A developer for developing an electrostatic latent image (4) is prepared by using the resulting toner particles in the same manner as in the preparation of the developer for developing an electrostatic latent image (1).

Production Example of Developer for Developing Electrostatic Latent Image (5)

(Aggregation Step)

| Preparation of Aggregated Particles | |
|---|---|
| Resin particle dispersion (5) | 2,833 parts |
| Colorant dispersion (1) | 100 parts |
| Releasing agent particle dispersion | 125 parts |
| Ester compound particle dispersion (1) | 200 parts |
| Lauroyl peroxide | 10 parts |
| Aluminum sulfate (produced by Wako Pure Chemical Industries, Ltd.) | 5 parts |
| Ion exchanged water | 100 parts |

The foregoing components are placed in a round flask made of stainless steel and adjusted to pH 2.0. The contents of the flask are dispersed by using a homogenizer (Ultra-Turrax T50, produced by IKA Corp.) and heated over an oil bath for heating to 65° C. under stirring. After maintaining at 65° C. for 70 minutes, the observation by an optical microscope confirms that aggregated particles having an average particle diameter of about 5.5 μm are formed. After further maintaining at 65° C. for 60 minutes, the observation by an optical microscope confirms that aggregated particles having an average particle diameter of about 5.7 μm are formed.

(Coalescing Step)

The aggregated particle dispersion has pH of 2.3. An aqueous solution obtained by diluting sodium carbonate (produced by Wako Pure Chemical Industries, Ltd.) to 0.5% by weight is gradually added thereto to adjust the pH to 5.5, and the mixture is then heated to 90° C. under continuous stirring, followed by maintaining for 5 hours.

Thereafter, the reaction product is filtered and sufficiently washed with ion exchanged water, followed by drying by using a vacuum dryer, so as to obtain toner particles.

(Evaluation)

The resulting toner particles have an average particle diameter of 5.9 μm. A developer for developing an electrostatic latent image (5) is prepared by using the resulting toner particles in the same manner as in the preparation of the developer for developing an electrostatic latent image (1).

Production Example of Developer for Developing Electrostatic Latent Image (6)

(Aggregation Step)

| Preparation of Aggregated Particles | |
|---|---|
| Resin particle dispersion (6) | 1,063 parts |
| Colorant dispersion (1) | 100 parts |
| Releasing agent particle dispersion | 125 parts |
| Ester compound particle dispersion (1) | 200 parts |
| Lauroyl peroxide | 8 parts |
| Aluminum sulfate (produced by Wako Pure Chemical Industries, Ltd.) | 5 parts |
| Ion exchanged water | 1000 parts |

The foregoing components are placed in a round flask made of stainless steel and adjusted to pH 2.0. The contents of the flask are dispersed by using a homogenizer (Ultra-Turrax T50, produced by IKA Corp.) and heated over an oil bath for heating to 64° C. under stirring. After maintaining at 64° C. for 50 minutes, the observation by an optical microscope confirms that aggregated particles having an average particle diameter of about 5.1 μm are formed. After further maintaining at 64° C. for 40 minutes, the observation by an optical microscope confirms that aggregated particles having an average particle diameter of about 5.2 μm are formed.

(Coalescing Step)

The aggregated particle dispersion has pH of 2.2. An aqueous solution obtained by diluting sodium hydrogencarbonate (produced by Wako Pure Chemical Industries, Ltd.) to 0.5% by weight is gradually added thereto to adjust the pH to 7.2, and the mixture is then heated to 90° C. under continuous stirring, followed by maintaining for 6 hours.

Thereafter, the reaction product is filtered and sufficiently washed with ion exchanged water, followed by drying by using a vacuum dryer, so as to obtain toner particles.

(Evaluation)

The resulting toner particles have an average particle diameter of 5.4 μm. A developer for developing an electrostatic latent image (6) is prepared by using the resulting toner particles in the same manner as in the preparation of the developer for developing an electrostatic latent image (1).

Production Example of Developer for Developing Electrostatic Latent Image (7)

(Aggregation Step)

| Preparation of Aggregated Particles | |
|---|---|
| Resin particle dispersion (1) | 2,767 parts |
| Colorant dispersion (2) | 117 parts |
| Releasing agent particle dispersion | 125 parts |
| Ester compound particle dispersion (1) | 200 parts |
| Lauroyl peroxide | 12 parts |
| Aluminum sulfate (produced by Wako Pure Chemical Industries, Ltd.) | 7 parts |
| Ion exchanged water | 150 parts |

The foregoing components are placed in a round flask made of stainless steel and adjusted to pH 2.0. The contents of the flask are dispersed by using a homogenizer (Ultra-Turrax T50, produced by IKA Corp.) and heated over an oil bath for heating to 64° C. under stirring. After maintaining at 68° C. for 50 minutes, the observation by an optical microscope confirms that aggregated particles having an average particle diameter of about 4.9 μm are formed. After further maintaining at 68° C. for 60 minutes, the observation by an optical microscope confirms that aggregated particles having an average particle diameter of about 5.3 μm are formed.

(Coalescing Step)

The aggregated particle dispersion has pH of 2.5. An aqueous solution obtained by diluting sodium hydrogencarbonate (produced by Wako Pure Chemical Industries, Ltd.) to 0.5% by weight is gradually added thereto to adjust the pH to 5.2, and the mixture is then heated to 90° C. under continuous stirring, followed by maintaining for 6 hours.

Thereafter, the reaction product is filtered and sufficiently washed with ion exchanged water, followed by drying by using a vacuum dryer, so as to obtain toner particles.

(Evaluation)

The resulting toner particles have an average particle diameter of 5.5 μm. A developer for developing an electrostatic latent image (7) is prepared by using the resulting toner particles in the same manner as in the preparation of the developer for developing an electrostatic latent image (1).

Production Example of Developer for Developing Electrostatic Latent Image (8)

(Aggregation Step)

| Preparation of Aggregated Particles | |
|---|---|
| Resin particle dispersion (1) | 2,667 parts |
| Colorant dispersion (3) | 250 parts |
| Releasing agent particle dispersion | 125 parts |
| Ester compound particle dispersion (1) | 200 parts |
| Lauroyl peroxide | 7 parts |
| Aluminum sulfate (produced by Wako Pure Chemical Industries, Ltd.) | 7 parts |
| Ion exchanged water | 120 parts |

The foregoing components are placed in a round flask made of stainless steel and adjusted to pH 2.0. The contents of the flask are dispersed by using a homogenizer (Ultra-Turrax T50, produced by IKA Corp.) and heated over an oil bath for heating to 68° C. under stirring. After maintaining at 68° C. for 60 minutes, the observation by an optical microscope confirms that aggregated particles having an average particle diameter of about 4.5 μm are formed. After further maintaining at 68° C. for 60 minutes, the observation by an optical microscope confirms that aggregated particles having an average particle diameter of about 5.0 μm are formed.

(Coalescing Step)

The aggregated particle dispersion has pH of 2.4. An aqueous solution obtained by diluting sodium hydrogencarbonate (produced by Wako Pure Chemical Industries, Ltd.) to 0.5% by weight is gradually added thereto to adjust the pH to 7.2, and the mixture is then heated to 90° C. under continuous stirring, followed by maintaining for 4 hours.

Thereafter, the reaction product is filtered and sufficiently washed with ion exchanged water, followed by drying by using a vacuum dryer, so as to obtain toner particles.

(Evaluation)

The resulting toner particles have an average particle diameter of 5.2 μm. A developer for developing an electrostatic latent image (8) is prepared by using the resulting toner particles in the same manner as in the preparation of the developer for developing an electrostatic latent image (1).

Production Example of Developer for Developing Electrostatic Latent Image (9)

(Aggregation Step)

| Preparation of Aggregated Particles | |
|---|---|
| Resin particle dispersion (1) | 2,833 parts |
| Colorant dispersion (4) | 109 parts |
| Releasing agent particle dispersion | 125 parts |
| Ester compound particle dispersion (1) | 200 parts |
| Lauroyl peroxide | 10 parts |
| Aluminum sulfate (produced by Wako Pure Chemical Industries, Ltd.) | 5 parts |
| Ion exchanged water | 100 parts |

The foregoing components are placed in a round flask made of stainless steel and adjusted to pH 2.0. The contents of the flask are dispersed by using a homogenizer (Ultra-Turrax T50, produced by IKA Corp.) and heated over an oil bath for heating to 67° C. under stirring. After maintaining at 67° C. for 60 minutes, the observation by an optical microscope confirms that aggregated particles having an average particle diameter of about 4.8 μm are formed. After further maintaining at 67° C. for 60 minutes, the observation by an optical microscope confirms that aggregated particles having an average particle diameter of about 5.0 μm are formed.

(Coalescing Step)

The aggregated particle dispersion has pH of 2.3. An aqueous solution obtained by diluting sodium hydrogencarbonate (produced by Wako Pure Chemical Industries, Ltd.) to 0.5% by weight is gradually added thereto to adjust the pH to 5.5, and the mixture is then heated to 90° C. under continuous stirring, followed by maintaining for 4 hours.

Thereafter, the reaction product is filtered and sufficiently washed with ion exchanged water, followed by drying by using a vacuum dryer, so as to obtain toner particles.

(Evaluation)

The resulting toner particles have an average particle diameter of 5.2 μm. A developer for developing an electrostatic latent image (9) is prepared by using the resulting toner particles in the same manner as in the preparation of the developer for developing an electrostatic latent image (1).

Production Example of Developer for Developing Electrostatic Latent Image (10)

(Aggregation Step)

| Preparation of Aggregated Particles | |
|---|---|
| Resin particle dispersion (1) | 2,833 parts |
| Colorant dispersion (1) | 100 parts |
| Releasing agent particle dispersion | 125 parts |
| Ester compound particle dispersion (2) | 200 parts |
| Lauroyl peroxide | 10 parts |
| Aluminum sulfate (produced by Wako Pure Chemical Industries, Ltd.) | 5 parts |
| Ion exchanged water | 100 parts |

The foregoing components are placed in a round flask made of stainless steel and adjusted to pH 2.0. The contents of the flask are dispersed by using a homogenizer (Ultra-Turrax T50, produced by IKA Corp.) and heated over an oil bath for heating to 65° C. under stirring. After maintaining at 65° C. for 60 minutes, the observation by an optical microscope confirms that aggregated particles having an average particle diameter of about 4.9 μm are formed. After further maintaining at 65° C. for 60 minutes, the observation by an optical microscope confirms that aggregated particles having an average particle diameter of about 5.1 μm are formed.

(Coalescing Step)

The aggregated particle dispersion has pH of 2.2. An aqueous solution obtained by diluting sodium carbonate (produced by Wako Pure Chemical Industries, Ltd.) to 0.5% by weight is gradually added thereto to adjust the pH to 5.0, and the mixture is then heated to 90° C. under continuous stirring, followed by maintaining for 4 hours.

Thereafter, the reaction product is filtered and sufficiently washed with ion exchanged water, followed by drying by using a vacuum dryer, so as to obtain toner particles.

(Evaluation)

The resulting toner particles have an average particle diameter of 5.2 μm. A developer for developing an electrostatic latent image (10) is prepared by using the resulting toner particles in the same manner as in the preparation of the developer for developing an electrostatic latent image (1).

Production Example of Developer for Developing Electrostatic Latent Image (11)

(Aggregation Step)

| Preparation of Aggregated Particles | |
|---|---|
| Resin particle dispersion (1) | 2,833 parts |
| Colorant dispersion (1) | 100 parts |
| Releasing agent particle dispersion | 125 parts |
| Ester compound particle dispersion (3) | 200 parts |
| Lauroyl peroxide | 10 parts |
| Aluminum sulfate (produced by Wako Pure Chemical Industries, Ltd.) | 5 parts |
| Ion exchanged water | 100 parts |

The foregoing components are placed in a round flask made of stainless steel and adjusted to pH 2.0. The contents of the flask are dispersed by using a homogenizer (Ultra-Turrax T50, produced by IKA Corp.) and heated over an oil bath for heating to 65° C. under stirring. After maintaining at 65° C. for 60 minutes, the observation by an optical microscope confirms that aggregated particles having an average particle diameter of about 4.5 μm are formed. After further maintaining at 65° C. for 60 minutes, the observation by an optical microscope confirms that aggregated particles having an average particle diameter of about 4.8 μm are formed.

(Coalescing Step)

The aggregated particle dispersion has pH of 2.2. An aqueous solution obtained by diluting sodium carbonate (produced by Wako Pure Chemical Industries, Ltd.) to 0.5% by weight is gradually added thereto to adjust the pH to 5.0, and the mixture is then heated to 90° C. under continuous stirring, followed by maintaining for 4 hours.

Thereafter, the reaction product is filtered and sufficiently washed with ion exchanged water, followed by drying by using a vacuum dryer, so as to obtain toner particles.

(Evaluation)

The resulting toner particles have an average particle diameter of 5.0 μm. A developer for developing an electrostatic latent image (11) is prepared by using the resulting toner particles in the same manner as in the preparation of the developer for developing an electrostatic latent image (1).

Production Example of Developer for Developing Electrostatic Latent Image (12)

(Aggregation Step)

| Preparation of Aggregated Particles | |
|---|---|
| Resin particle dispersion (1) | 2,833 parts |
| Colorant dispersion (1) | 100 parts |
| Releasing agent particle dispersion | 125 parts |
| Ester compound particle dispersion (4) | 200 parts |
| Lauroyl peroxide | 10 parts |
| Aluminum sulfate (produced by Wako Pure Chemical Industries, Ltd.) | 5 parts |
| Ion exchanged water | 100 parts |

The foregoing components are placed in a round flask made of stainless steel and adjusted to pH 2.0. The contents of the flask are dispersed by using a homogenizer (Ultra-Turrax T50, produced by IKA Corp.) and heated over an oil bath for heating to 65° C. under stirring. After maintaining at 65° C. for 60 minutes, the observation by an optical microscope confirms that aggregated particles having an average particle diameter of about 4.9 μm are formed. After further maintaining at 65° C. for 60 minutes, the observation by an optical microscope confirms that aggregated particles having an average particle diameter of about 4.9 μm are formed.

(Coalescing Step)

The aggregated particle dispersion has pH of 2.2. An aqueous solution obtained by diluting sodium carbonate (produced by Wako Pure Chemical Industries, Ltd.) to 0.5% by weight is gradually added thereto to adjust the pH to 5.1, and the mixture is then heated to 90° C. under continuous stirring, followed by maintaining for 4 hours.

Thereafter, the reaction product is filtered and sufficiently washed with ion exchanged water, followed by drying by using a vacuum dryer, so as to obtain toner particles.

(Evaluation)

The resulting toner particles have an average particle diameter of 5.1 μm. A developer for developing an electrostatic latent image (12) is prepared by using the resulting toner particles in the same manner as in the preparation of the developer for developing an electrostatic latent image (1).

Production Example of Developer for Developing Electrostatic Latent Image (13)

(Aggregation Step)

| Preparation of Aggregated Particles | |
|---|---|
| Resin particle dispersion (1) | 2,833 parts |
| Colorant dispersion (1) | 100 parts |
| Releasing agent particle dispersion | 125 parts |
| Ester compound particle dispersion (5) | 200 parts |
| Lauroyl peroxide | 10 parts |
| Aluminum sulfate (produced by Wako Pure Chemical Industries, Ltd.) | 5 parts |
| Ion exchanged water | 100 parts |

The foregoing components are placed in a round flask made of stainless steel and adjusted to pH 2.0. The contents of the flask are dispersed by using a homogenizer (Ultra-Turrax T50, produced by IKA Corp.) and heated over an oil bath for heating to 65° C. under stirring. After maintaining at 65° C. for 60 minutes, the observation by an optical microscope confirms that aggregated particles having an average particle diameter of about 4.9 μm are formed. After further maintaining at 65° C. for 60 minutes, the observation by an optical microscope confirms that aggregated particles having an average particle diameter of about 5.4 μm are formed.

(Coalescing Step)

The aggregated particle dispersion has pH of 2.2. An aqueous solution obtained by diluting sodium carbonate (produced by Wako Pure Chemical Industries, Ltd.) to 0.5% by weight is gradually added thereto to adjust the pH to 4.8, and the mixture is then heated to 90° C. under continuous stirring, followed by maintaining for 4 hours.

Thereafter, the reaction product is filtered and sufficiently washed with ion exchanged water, followed by drying by using a vacuum dryer, so as to obtain toner particles.

(Evaluation)

The resulting toner particles have an average particle diameter of 5.7 μm. A developer for developing an electrostatic latent image (13) is prepared by using the resulting toner particles in the same manner as in the preparation of the developer for developing an electrostatic latent image (1).

Production Example of Developer for Developing Electrostatic Latent Image (14)

(Aggregation Step)

| Preparation of Aggregated Particles | |
|---|---|
| Resin particle dispersion (1) | 2,833 parts |
| Colorant dispersion (1) | 100 parts |
| Releasing agent particle dispersion | 125 parts |
| Ester compound particle dispersion (6) | 200 parts |
| Lauroyl peroxide | 10 parts |
| Aluminum sulfate (produced by Wako Pure Chemical Industries, Ltd.) | 5 parts |
| Ion exchanged water | 100 parts |

The foregoing components are placed in a round flask made of stainless steel and adjusted to pH 2.0. The contents of the flask are dispersed by using a homogenizer (Ultra-Turrax T50, produced by IKA Corp.) and heated over an oil bath for heating to 65° C. under stirring. After maintaining at 65° C. for 60 minutes, the observation by an optical microscope confirms that aggregated particles having an average particle diameter of about 5.0 μm are formed. After further maintaining at 65° C. for 60 minutes, the observation by an optical microscope confirms that aggregated particles having an average particle diameter of about 5.2 μm are formed.

(Coalescing Step)

The aggregated particle dispersion has pH of 2.2. An aqueous solution obtained by diluting sodium carbonate (produced by Wako Pure Chemical Industries, Ltd.) to 0.5% by weight is gradually added thereto to adjust the pH to 5.2, and the mixture is then heated to 90° C. under continuous stirring, followed by maintaining for 4 hours.

Thereafter, the reaction product is filtered and sufficiently washed with ion exchanged water, followed by drying by using a vacuum dryer, so as to obtain toner particles.

(Evaluation)

The resulting toner particles have an average particle diameter of 5.3 μm. A developer for developing an electrostatic latent image (14) is prepared by using the resulting toner particles in the same manner as in the preparation of the developer for developing an electrostatic latent image (1).

Production Example of Developer for Developing Electrostatic Latent Image (15)

(Aggregation Step)

| Preparation of Aggregated Particles | |
|---|---|
| Resin particle dispersion (1) | 2,833 parts |
| Colorant dispersion (1) | 100 parts |
| Releasing agent particle dispersion | 125 parts |
| Ester compound particle dispersion (1) | 100 parts |
| Ester compound particle dispersion (6) | 100 parts |
| Lauroyl peroxide | 10 parts |
| Aluminum sulfate (produced by Wako Pure Chemical Industries, Ltd.) | 5 parts |
| Ion exchanged water | 100 parts |

The foregoing components are placed in a round flask made of stainless steel and adjusted to pH 2.0. The contents of the flask are dispersed by using a homogenizer (Ultra-Turrax T50, produced by IKA Corp.) and heated over an oil bath for heating to 65° C. under stirring. After maintaining at 65° C. for 60 minutes, the observation by an optical microscope confirms that aggregated particles having an average particle diameter of about 4.8 μm are formed. After further maintaining at 65° C. for 60 minutes, the observation by an optical microscope confirms that aggregated particles having an average particle diameter of about 5.1 μm are formed.

(Coalescing Step)

The aggregated particle dispersion has pH of 2.2. An aqueous solution obtained by diluting sodium carbonate (produced by Wako Pure Chemical Industries, Ltd.) to 0.5% by weight is gradually added thereto to adjust the pH to 5.0, and the mixture is then heated to 90° C. under continuous stirring, followed by maintaining for 4 hours.

Thereafter, the reaction product is filtered and sufficiently washed with ion exchanged water, followed by drying by using a vacuum dryer, so as to obtain toner particles.

(Evaluation)

The resulting toner particles have an average particle diameter of 5.5 μm. A developer for developing an electrostatic latent image (15) is prepared by using the resulting toner particles in the same manner as in the preparation of the developer for developing an electrostatic latent image (1).

Production Example of Developer for Developing Electrostatic Latent Image (16)

(Aggregation Step)

| Preparation of Aggregated Particles | |
|---|---|
| Resin particle dispersion (1) | 2,833 parts |
| Colorant dispersion (1) | 100 parts |
| Releasing agent particle dispersion | 125 parts |
| Lauroyl peroxide | 10 parts |
| Aluminum sulfate (produced by Wako Pure Chemical Industries, Ltd.) | 5 parts |
| Ion exchanged water | 300 parts |

The foregoing components are placed in a round flask made of stainless steel and adjusted to pH 2.0. The contents of the flask are dispersed by using a homogenizer (Ultra-Turrax T50, produced by IKA Corp.) and heated over an oil bath for heating to 65° C. under stirring. After maintaining at 65° C. for 60 minutes, the observation by an optical microscope confirms that aggregated particles having an average particle diameter of about 4.9 μm are formed. After further maintaining at 65° C. for 60 minutes, the observation by an optical microscope confirms that aggregated particles having an average particle diameter of about 5.3 μm are formed.

(Coalescing Step)

The aggregated particle dispersion has pH of 2.2. An aqueous solution obtained by diluting sodium carbonate (produced by Wako Pure Chemical Industries, Ltd.) to 0.5% by weight is gradually added thereto to adjust the pH to 5.0, and the mixture is then heated to 90° C. under continuous stirring, followed by maintaining for 4 hours.

Thereafter, the reaction product is filtered and sufficiently washed with ion exchanged water, followed by drying by using a vacuum dryer, so as to obtain toner particles.

(Evaluation)

The resulting toner particles have an average particle diameter of 5.5 μm, and the particle size distribution is slightly broad. A developer for developing an electrostatic latent image (16) is prepared by using the resulting toner particles in the same manner as in the preparation of the developer for developing an electrostatic latent image (1).

Production Example of Developer for Developing Electrostatic Latent Image (17)

(Aggregation Step)

| Preparation of Aggregated Particles | |
|---|---|
| Resin particle dispersion (1) | 2,833 parts |
| Colorant dispersion (1) | 100 parts |
| Releasing agent particle dispersion | 125 parts |
| Ester compound particle dispersion (7) | 100 parts |
| Lauroyl peroxide | 10 parts |
| Aluminum sulfate (produced by Wako Pure Chemical Industries, Ltd.) | 5 parts |
| Ion exchanged water | 300 parts |

The foregoing components are placed in a round flask made of stainless steel and adjusted to pH 2.0. The contents of the flask are dispersed by using a homogenizer (Ultra-Turrax T50, produced by IKA Corp.) and heated over an oil bath for heating to 65° C. under stirring. After maintaining at 65° C. for 60 minutes, the observation by an optical microscope confirms that aggregated particles having an average particle diameter of about 4.8 μm are formed. After further maintaining at 65° C. for 60 minutes, the observation by an optical microscope confirms that aggregated particles having an average particle diameter of about 5.1 μm are formed.

(Coalescing Step)

The aggregated particle dispersion has pH of 2.2. An aqueous solution obtained by diluting sodium carbonate (produced by Wako Pure Chemical Industries, Ltd.) to 0.5% by weight is gradually added thereto to adjust the pH to 5.0, and the mixture is then heated to 90° C. under continuous stirring, followed by maintaining for 4 hours.

Thereafter, the reaction product is filtered and sufficiently washed with ion exchanged water, followed by drying by using a vacuum dryer, so as to obtain toner particles.

(Evaluation)

The resulting toner particles have an average particle diameter of 5.3 μm, and the particle size distribution is slightly broad. A developer for developing an electrostatic latent image (17) is prepared by using the resulting toner particles in the same manner as in the preparation of the developer for developing an electrostatic latent image (1).

Preparation of Apparatus for Forming Image (1)

The fixing unit of a color duplicator, Acolor 930, produced by Fuji Xerox Co., Ltd., is detached, from which the releasing oil supplying unit is then detached, and a fixing unit containing a fixing roll and a pressure roll having films of a ethylene-vinylidene fluoride-tetrafluoroethylene copolymer on the surfaces thereof is installed, so as to prepare an apparatus for forming an image (1).

Preparation of Apparatus for Forming Image (2)

An apparatus for forming an image (2) is prepared in the same manner as in the apparatus for forming an image (1) except that a fixing belt formed with a polyimide film is used instead of the pressure roll.

EXAMPLE 1

The developer of the production example of a developer for developing an electrostatic latent image (1) is installed in a developing unit of the apparatus for forming an image (1), and a non-fixed image is prepared to have a solid part and a thin line part. The non-fixed image is fixed by the fixing unit of the apparatus for forming an image (1) in such a manner that the rotation speed of the roll is adjusted to make the contact time of the fixing roll and the non-fixed image be 0.04 second, with the surface temperature of the fixing roll varying from 60 to 200° C. at an interval of 5° C. The fixed image is folded inside at the substantial center of the solid part of the fixed image to evaluate the breakage of the fixed image, and the fixing temperature where no problem occurs is designated as the lowest fixing temperature. Reproducibility of the thin lines, background fogging and hot offset are evaluated with the naked eye.

EXAMPLES 2 TO 15

Fixing is conducted and evaluated in the same manner as in Example 1 except that the developers of the production examples of a developer for developing an electrostatic latent image (2) to (15) are used.

EXAMPLE 16

The developer of the production example of a developer for developing an electrostatic latent image (1) is installed in a developing unit of the apparatus for forming an image (2), and a non-fixed image is prepared to have a solid part and a thin line part. The non-fixed image is fixed under the same conditions as in Example 1 except that the speed of the belt is adjusted to make the contact time of the fixing belt of the fixing unit of the apparatus for forming an image (2) and the non-fixed image be 0.08 second. A fixing operation is conducted in the same manner as in Example 1 about other conditions and evaluation is conducted for the image.

COMPARATIVE EXAMPLE 1

A fixing operation is conducted in the same manner as in Example 1 except that the developer of the production example of a developer for developing an electrostatic latent image (16) is used, and evaluation is conducted in the same manner as in Example 1.

COMPARATIVE EXAMPLE 2

A fixing operation is conducted in the same manner as in Example 1 except that the developer for Acolor 936, produced by Fuji Xerox Co., Ltd. is used, and evaluation is conducted in the same manner as in Example 1.

COMPARATIVE EXAMPLE 3

A fixing operation is conducted in the same manner as in Example 1 except that the developer of the production example of a developer for developing an electrostatic latent image (17) is used, and evaluation is conducted in the same manner as in Example 1.

Evaluation

The characteristics of the toners used in Examples 1 to 15 and Comparative Examples 1 to 3 are shown in Table 1 below, and the average particle diameter, the particle size distribution GSDv and the fixing characteristics thereof are shown in Table 2 below. In the tables, Tm represents the melting point of the toner, GL(30) represents the storage elastic modulus at 30° C.; GL(Tm) and GL(Tm+10) represent the storage elastic modulus at the melting point and that at a temperature higher by 10° C. than the melting point, respectively; GN(Tm) and GN(Tm+10) represent the loss elastic modulus at the melting point and that at a temperature higher by 10° C. than the melting point, respectively; Δlog GL represents |log GL(Tm+20)−log GL(Tm+50)|; and Δlog GN represents |log GN(Tm+20)−log GN(Tm+50)|.

TABLE 1

| | Tm (° C.) | GL(30) × $10^5$ | GL(Tm) × $10^5$ | GL(Tm + 10) × $10^3$ | GN(Tm) × $10^5$ | GN(Tm + 10) × $10^3$ | Δlog GL | Δlog GN |
|---|---|---|---|---|---|---|---|---|
| Example 1 | 72 | 2.1 | 7.6 | 5.0 | 7.4 | 4.6 | 1.1 | 1.2 |
| Example 2 | 92 | 5.3 | 6.5 | 6.2 | 6.3 | 5.9 | 1.2 | 1.0 |
| Example 3 | 49 | 1.6 | 1.8 | 9.2 | 1.9 | 9.0 | 1.4 | 1.4 |
| Example 4 | 88 | 4.8 | 5.4 | 2.2 | 5.1 | 2.3 | 0.4 | 0.3 |
| Example 5 | 70 | 2.0 | 8.6 | 1.5 | 8.5 | 1.4 | 0.6 | 0.6 |
| Example 6 | 67 | 1.8 | 3.2 | 8.3 | 3.2 | 8.2 | 0.3 | 0.2 |
| Example 7 | 71 | 2.1 | 7.7 | 5.2 | 7.4 | 4.5 | 1.0 | 1.2 |
| Example 8 | 72 | 2.1 | 7.6 | 4.8 | 7.2 | 4.5 | 1.0 | 1.1 |
| Example 9 | 71 | 2.1 | 7.6 | 5.0 | 7.5 | 4.7 | 0.9 | 0.9 |
| Example 10 | 70 | 2.1 | 7.4 | 4.9 | 7.4 | 5.0 | 1.0 | 1.1 |
| Example 11 | 72 | 2.1 | 7.3 | 4.6 | 7.2 | 4.4 | 0.6 | 0.5 |
| Example 12 | 72 | 2.1 | 7.0 | 3.8 | 6.8 | 3.6 | 0.8 | 0.7 |
| Example 13 | 71 | 2.1 | 7.1 | 5.2 | 6.8 | 5.0 | 1.2 | 1.3 |
| Example 14 | 72 | 2.1 | 7.4 | 5.0 | 7.3 | 5.0 | 1.0 | 0.8 |
| Example 15 | 72 | 2.1 | 7.1 | 4.0 | 6.8 | 3.6 | 0.7 | 0.6 |
| Comparative Example 1 | 73 | 2.1 | 7.2 | 4.8 | 7.1 | 4.5 | 1.2 | 1.1 |
| Comparative Example 2 | — | 1.6 | — | — | — | — | — | — |

TABLE 2

| | Average diameter (μm) | GSDv | Fixing temperature (° C.) | Reproducibility of thin lines | Background fogging | Hot offset |
|---|---|---|---|---|---|---|
| Example 1 | 5.2 | 1.23 | 85 | good | none | no occurrence |
| Example 2 | 5.7 | 1.21 | 100 | good | none | no occurrence |
| Example 3 | 4.7 | 1.25 | 60 | good | none | no occurrence |
| Example 4 | 6.6 | 1.26 | 95 | good | none | no occurrence |
| Example 5 | 5.9 | 1.24 | 80 | good | none | no occurrence |
| Example 6 | 5.4 | 1.22 | 75 | good | none | no occurrence |
| Example 7 | 5.5 | 1.21 | 85 | good | none | no occurrence |
| Example 8 | 5.2 | 1.25 | 80 | good | none | no occurrence |
| Example 9 | 5.2 | 1.25 | 85 | good | none | no occurrence |
| Example 10 | 5.2 | 1.24 | 85 | good | none | no occurrence |
| Example 11 | 5.0 | 1.27 | 85 | good | none | no occurrence |
| Example 12 | 5.1 | 1.22 | 85 | good | none | no occurrence |
| Example 13 | 5.7 | 1.24 | 85 | good | none | no occurrence |
| Example 14 | 5.3 | 1.23 | 85 | good | none | no occurrence |
| Example 15 | 5.5 | 1.22 | 85 | good | none | no occurrence |
| Example 16 | 5.2 | 1.22 | 90 | good | none | no occurrence |
| Comparative Example 1 | 5.5 | 1.35 | 85 | slightly poor | slight occurrence | no occurrence |
| Comparative Example 2 | 7.0 | 1.34 | 150 | slightly poor | slight occurrence | occurrence at 180° C. |
| Comparative Example 3 | 5.3 | 1.39 | 85 | slightly poor | slight occurrence | no occurrence |

It is understood from Tables 1 and 2 that, in comparison to the developers for developing an electrostatic latent image containing the toners for developing an electrostatic latent image of Comparative Examples 1 to 3, the developers for developing an electrostatic latent image containing the toners for developing an electrostatic latent image of Examples 1 to 15 have a narrow particle size distribution, i.e., the particle diameters of the respective particles of the toner can be uniformized, and therefore the toners for developing an electrostatic latent image can be obtained that are excellent in reproducibility of thin lines and cause no background fogging. Furthermore, when the same developer for developing an electrostatic latent image containing the toner for developing an electrostatic latent image as in Example 1 is installed in the apparatus for forming an image (2) having a fixing belt, and the image quality is evaluated, an image that is excellent in reproducibility of thin lines and causes no background fogging can be stably formed as similar to the other Examples.

Experimental examples of a toner for developing an electrostatic latent image containing at least one resin having a contact angle with water that is smaller than the crystalline resin will be described below.

The contact angle with water of the resin is measured by using a commercially available contact angle meter (Type CA-DTA, produced by Kyowa Interface Science Co., Ltd.) in the following manner. Powder of the resin to be measured is middle under pressure of about 20 ton/cm2 for 30 seconds to produce a resin plate. A water droplet is made in contact with the surface of the resin plate, and the contact angle is measured at room temperature.

| Preparation of Resin Particle Dispersion (7) | |
|---|---|
| Sebacic acid | 940.7 parts |
| Ethylene glycol | 310.5 parts |
| Fumaric acid | 40.6 parts |
| Dibutyl tin | 2.0 parts |
| (all produced by Wako Pure Chemical Industries, Ltd.) | |

The foregoing components are mixed in a flask and heated to 240° C. under reduced pressure to conduct dehydration condensation for 6 hours, so as to obtain a resin. After cooling, it is found that the resin has a melting point of 72° C. and a contact angle with water of 88°. 150 parts of the resin are put in 850 parts of distilled water and mixed by agitation with a homogenizer (Ultra-Turrax, produced by IKA Japan Co., Ltd.) under heating to 85° C., so as to obtain a resin particle dispersion (7).

| Preparation of Resin Particle Dispersion (8) | |
|---|---|
| Succinic acid | 679.4 parts |
| Butanediol | 450.5 parts |
| Fumaric acid | 40.6 parts |
| Dibutyl tin | 2.5 parts |
| (all produced by Wako Pure Chemical Industries, Ltd.) | |

The foregoing components are subjected to dehydration condensation under the same conditions as in the resin particle dispersion (7) to obtain a resin having a melting point of 91° C. and a contact angle with water of 86°. The resin is then subjected to mixing by agitation under the same conditions as in the resin particle dispersion (7) to obtain a resin particle dispersion (8).

| Preparation of Resin Particle Dispersion (9) | |
|---|---|
| Azelaic acid | 875.1 parts |
| Butanediol | 450.5 parts |
| Fumaric acid | 40.7 parts |
| Dibutyl tin | 2.0 parts |
| (all produced by Wako Pure Chemical Industries, Ltd.) | |

The foregoing components are subjected to dehydration condensation under the same conditions as in the resin particle dispersion (7) to obtain a resin having a melting point of 60° C. and a contact angle with water of 89°. The resin is then subjected to mixing by agitation under the same conditions as in the resin particle dispersion (7) to obtain a resin particle dispersion (9).

| Preparation of Resin Particle Dispersion (10) | |
|---|---|
| Terephthalic acid | 772.4 parts |
| Decanediol | 871.5 parts |
| Fumaric acid | 40.6 parts |
| Dibutyl tin | 2.0 parts |
| (all produced by Wako Pure Chemical Industries, Ltd.) | |

The foregoing components are subjected to dehydration condensation under the same conditions as in the resin particle dispersion (7) to obtain a resin having a melting point of 86° C. and a contact angle with water of 82°. The resin is then subjected to mixing by agitation under the same conditions as in the resin particle dispersion (7) to obtain a resin particle dispersion (10).

| Preparation of Resin Particle Dispersion (11) | |
|---|---|
| Sebacic acid | 900.2 parts |
| Ethylene glycol | 450.5 parts |
| Sodium isophthalate-5-sulfonate | 53.2 parts |
| Fumaric acid | 40.6 parts |
| Dibutyl tin | 2.0 parts |
| (all produced by Wako Pure Chemical Industries, Ltd.) | |

The foregoing components are subjected to dehydration condensation under the same conditions as in the resin particle dispersion (7) to obtain a resin having a melting point of 69° C. and a contact angle with water of 89°. The resin is then subjected to mixing by agitation under the same conditions as in the resin particle dispersion (7) to obtain a resin particle dispersion (11).

| Preparation of Resin Particle Dispersion (12) | |
|---|---|
| Styrene | 300 parts |
| Stearyl acrylate | 700 parts |
| Dodecylmercaptan | 6 parts |
| (all produced by Wako Pure Chemical Industries, Ltd.) | |
| Decanediol diacrylate | 4 parts |
| (produced by Shin-Nakamura Chemical Co., Ltd.) | |

A solution obtained by mixing and dissolving the foregoing components is dispersed and emulsified in a solution obtained by dissolving 20 parts of an anionic surfactant (Newlex Paste H, produced by NOF Corp.) in 1,300 parts of ion exchanged water in a flask. The dispersion is slowly mixed over 10 minutes, and 200 parts of ion exchanged water having 20 parts of ammonium persulfate (produced by Wako Pure Chemical Industries, Ltd.) dissolved therein are put therein. After conducting substitution with nitrogen, the content of the flask is heated over an oil bath until the content reaches 70° C. under stirring, and emulsion polymerization is continued under the same conditions for 6 hours. Thereafter, the reaction mixture is cooled to room temperature, followed by washing and drying, so as to obtain a resin particle dispersion (12) having a melting point of 61° C. and a contact angle with water of 82°.

| Preparation of Resin Particle Dispersion (13) | |
|---|---|
| Sebacic acid | 738.4 parts |
| Ethylene glycol | 310.5 parts |
| Sodium isophthalate-5-sulfonate | 266.2 parts |
| Fumaric acid | 40.6 parts |
| Dibutyl tin | 2.0 parts |
| (all produced by Wako Pure Chemical Industries, Ltd.) | |

The foregoing components are subjected to dehydration condensation under the same conditions as in the resin particle dispersion (7) to obtain a resin having a melting point of 59° C. and a contact angle with water of 79°. The resin is then subjected to mixing by agitation under the same conditions as in the resin particle dispersion (7) to obtain a resin particle dispersion (13).

| Preparation of Resin Particle Dispersion (14) | |
|---|---|
| Styrene | 300 parts |
| Stearyl acrylate | 700 parts |
| Acrylic acid | 20 parts |
| Dodecylmercaptan | 12 parts |
| (all produced by Wako Pure Chemical Industries, Ltd.) | |
| Decanediol diacrylate | 4 parts |
| (produced by Shin-Nakamura Chemical Co., Ltd.) | |

A solution obtained by mixing and dissolving the foregoing components is dispersed and emulsified in a solution obtained by dissolving 18 parts of an anionic surfactant (Newlex Paste H, produced by NOF Corp.) in 1,300 parts of ion exchanged water in a flask. The dispersion is slowly mixed over 10 minutes, and 200 parts of ion exchanged water having 16 parts of ammonium persulfate (produced by Wako Pure Chemical Industries, Ltd.) dissolved therein are put therein. After conducting substitution with nitrogen, the content of the flask is heated over an oil bath until the content reaches 70° C. under stirring, and emulsion polymerization is continued under the same conditions for 6 hours. Thereafter, the reaction mixture is cooled to room temperature to obtain a resin having a melting point of 56° C. and a contact angle with water of 78°. A resin particle dispersion (14) is prepared from the resultant resin under the same condition as in the resin particle dispersion (7).

Developer for Developing Electrostatic Latent Image (18) (Aggregation Step)

| Preparation of Aggregated Particles | |
|---|---|
| Resin particle dispersion (7) | 2,400 parts |
| (contact angle with water: 88°) | |
| Resin particle dispersion (13) | 600 parts |
| (contact angle with water: 79°) | |
| Colorant particle dispersion (1) | 100 parts |
| Releasing agent particle dispersion | 63 parts |
| Lauroyl peroxide | 10 parts |
| Aluminum sulfate | 5 parts |
| (produced by Wako Pure Chemical Industries, Ltd.) | |
| Ion exchanged water | 100 parts |

The foregoing components are placed in a round flask made of stainless steel and adjusted to pH 2. The contents of the flask are dispersed by using a homogenizer (Ultra-Turrax T50, produced by IKA Corp.) and heated over an oil bath for heating to 68° C. under stirring. After maintaining at 68° C. for 3 hours, the observation by an optical microscope confirms that aggregated particles having an average particle diameter of about 4.9 μm are formed. After further maintaining at 68° C. for 1 hour, the observation by an optical microscope confirms that aggregated particles having an average particle diameter of about 5.2 μm are formed.

(Coalescing Step)

The aggregated particle dispersion has pH of 2.4. An aqueous solution obtained by diluting sodium carbonate (produced by Wako Pure Chemical Industries, Ltd.) to 0.5% by weight is gradually added thereto to adjust the pH to 5.0, and the mixture is then heated to 85° C. under continuous stirring, followed by maintaining for 3 hours. Thereafter, the reaction product is filtered and sufficiently washed with ion exchanged water, followed by drying by using a vacuum dryer, so as to obtain toner particles.

The resulting toner particles have an average particle diameter of 5.3 μm. 1 Part of colloidal silica (R972, produced by Nippon Aerosil Co., Ltd.) is externally added to 100 parts of the toner particles, followed by mixing by a Henschel mixer, to obtain a toner for developing an electrostatic latent image.

Preparation of Developer for Developing Electrostatic Latent Image

100 Parts of ferrite particles (produced by Powder Tech Co., Ltd., average particle diameter: 50 μm) and 3.0 parts of a methacrylate resin (produced by Mitsubishi Rayon Co., Ltd., molecular weight: 95,000) are placed in a pressure kneader along with 500 parts of toluene, and mixed by stirring at ordinary temperature for 15 minutes. Thereafter, the temperature is increased to 70° C. with mixing under reduced pressure, and after distilling off toluene, the content is cooled and classified by using a sieve of 105 μm to produce a ferrite carrier (resin coated carrier). The ferrite carrier is mixed with the toner for developing an electrostatic latent image to produce a two-component developer for developing an electrostatic latent image (18) having a toner concentration of 7% by weight.

Developer for Developing Electrostatic Latent Image (19)

(Aggregation Step)

| Preparation of Aggregated Particles | |
|---|---|
| Resin particle dispersion (8) (contact angle with water: 86°) | 2,400 parts |
| Resin particle dispersion (13) (contact angle with water: 79°) | 600 parts |
| Colorant particle dispersion (1) | 100 parts |
| Releasing agent particle dispersion | 63 parts |
| Lauroyl peroxide | 10 parts |
| Aluminum sulfate (produced by Wako Pure Chemical Industries, Ltd.) | 5 parts |
| Ion exchanged water | 100 parts |

The foregoing components are placed in a round flask made of stainless steel and adjusted to pH 2.0. The contents of the flask are dispersed by using a homogenizer (Ultra-Turrax T50, produced by IKA Corp.) and heated over an oil bath for heating to 84° C. under stirring. After maintaining at 84° C. for 4 hours, the observation by an optical microscope confirms that aggregated particles having an average particle diameter of about 6.6 μm are formed. After further maintaining at 84° C. for 2 hours, the observation by an optical microscope confirms that aggregated particles having an average particle diameter of about 6.9 μm are formed.

(Coalescing Step)

The aggregated particle dispersion has pH of 2.3. An aqueous solution obtained by diluting sodium carbonate (produced by Wako Pure Chemical Industries, Ltd.) to 0.5% by weight is gradually added thereto to adjust the pH to 4.8, and the mixture is then heated to 98° C. under continuous stirring, followed by maintaining for 5 hours. Thereafter, the reaction product is filtered and sufficiently washed with ion exchanged water, followed by drying by using a vacuum dryer, so as to obtain toner particles.

The resulting toner particles have an average particle diameter of 7.2 μm. A developer for developing an electrostatic latent image (19) is produced by using the resulting toner particles in the same manner as in the developer for developing an electrostatic latent image (18).

Developer for Developing Electrostatic Latent Image (20)

(Aggregation Step)

| Preparation of Aggregated Particles | |
|---|---|
| Resin particle dispersion (9) (contact angle with water: 89°) | 2,833 parts |
| Resin particle dispersion (13) (contact angle with water: 79°) | 600 parts |
| Colorant particle dispersion (1) | 100 parts |
| Releasing agent particle dispersion | 125 parts |
| Lauroyl peroxide | 12 parts |
| Aluminum sulfate (produced by Wako Pure Chemical Industries, Ltd.) | 5 parts |
| Ion exchanged water | 100 parts |

The foregoing components are placed in a round flask made of stainless steel and adjusted to pH 2.0. The contents of the flask are dispersed by using a homogenizer (Ultra-Turrax T50, produced by IKA Corp.) and heated over an oil bath for heating to 49° C. under stirring. After maintaining at 49° C. for 2 hours, the observation by an optical microscope confirms that aggregated particles having an average particle diameter of about 4.0 μm are formed. After further maintaining at 49° C. for 2 hours, the observation by an optical microscope confirms that aggregated particles having an average particle diameter of about 4.2 μm are formed.

(Coalescing Step)

The aggregated particle dispersion has pH of 2.5. An aqueous solution obtained by diluting sodium hydrogencarbonate (produced by Wako Pure Chemical Industries, Ltd.) to 0.5% by weight is gradually added thereto to adjust the pH to 5.5, and the mixture is then heated to 75° C. under continuous stirring, followed by maintaining for 4 hours. Thereafter, the reaction product is filtered and sufficiently washed with ion exchanged water, followed by drying by using a vacuum dryer, so as to obtain toner particles.

The resulting toner particles have an average particle diameter of 4.3 μm. A developer for developing an electrostatic latent image (20) is produced by using the resulting toner particles in the same manner as in the developer for developing an electrostatic latent image (18).

Developer for Developing Electrostatic Latent Image (21)

(Aggregation Step)

| Preparation of Aggregated Particles | |
|---|---|
| Resin particle dispersion (10) (contact angle with water: 86°) | 2,400 parts |
| Resin particle dispersion (13) (contact angle with water: 79°) | 600 parts |
| Colorant particle dispersion (1) | 100 parts |
| Releasing agent particle dispersion | 63 parts |
| Lauroyl peroxide | 10 parts |

-continued

| Preparation of Aggregated Particles | |
|---|---|
| Aluminum sulfate (produced by Wako Pure Chemical Industries, Ltd.) | 5 parts |
| Ion exchanged water | 100 parts |

The foregoing components are placed in a round flask made of stainless steel and adjusted to pH 2.0. The contents of the flask are dispersed by using a homogenizer (Ultra-Turrax T50, produced by IKA Corp.) and heated over an oil bath for heating to 85° C. under stirring. After maintaining at 85° C. for 3 hours, the observation by an optical microscope confirms that aggregated particles having an average particle diameter of about 5.3 μm are formed. After further maintaining at 85° C. for 2 hours, the observation by an optical microscope confirms that aggregated particles having an average particle diameter of about 5.5 μm are formed.

(Coalescing Step)

The aggregated particle dispersion has pH of 2.3. An aqueous solution obtained by diluting sodium carbonate (produced by Wako Pure Chemical Industries, Ltd.) to 0.5% by weight is gradually added thereto to adjust the pH to 7.2, and the mixture is then heated to 95° C. under continuous stirring, followed by maintaining for 5 hours. Thereafter, the reaction product is filtered and sufficiently washed with ion exchanged water, followed by drying by using a vacuum dryer, so as to obtain toner particles.

The resulting toner particles have an average particle diameter of 5.7 μm. A developer for developing an electrostatic latent image (21) is produced by using the resulting toner particles in the same manner as in the developer for developing an electrostatic latent image (18).

Developer for Developing Electrostatic Latent Image (22)

(Aggregation Step)

| Preparation of Aggregated Particles | |
|---|---|
| Resin particle dispersion (11) (contact angle with water: 89°) | 2,400 parts |
| Resin particle dispersion (13) (contact angle with water: 79°) | 600 parts |
| Colorant particle dispersion (1) | 100 parts |
| Releasing agent particle dispersion | 63 parts |
| Lauroyl peroxide | 10 parts |
| Aluminum sulfate (produced by Wako Pure Chemical Industries, Ltd.) | 5 parts |
| Ion exchanged water | 100 parts |

The foregoing components are placed in a round flask made of stainless steel and adjusted to pH 2.0. The contents of the flask are dispersed by using a homogenizer (Ultra-Turrax T50, produced by IKA Corp.) and heated over an oil bath for heating to 64° C. under stirring. After maintaining at 64° C. for 3 hours, the observation by an optical microscope confirms that aggregated particles having an average particle diameter of about 5.0 μm are formed. After further maintaining at 65° C. for 3 hours, the observation by an optical microscope confirms that aggregated particles having an average particle diameter of about 5.3 μm are formed.

(Coalescing Step)

The aggregated particle dispersion has pH of 2.4. An aqueous solution obtained by diluting sodium carbonate (produced by Wako Pure Chemical Industries, Ltd.) to 0.5% by weight is gradually added thereto to adjust the pH to 6.0, and the mixture is then heated to 90° C. under continuous stirring, followed by maintaining for 5 hours. Thereafter, the reaction product is filtered and sufficiently washed with ion exchanged water, followed by drying by using a vacuum dryer, so as to obtain toner particles.

The resulting toner particles have an average particle diameter of 5.4 μm. A developer for developing an electrostatic latent image (22) is produced by using the resulting toner particles in the same manner as in the developer for developing an electrostatic latent image (18).

Developer for Developing Electrostatic Latent Image (23)

(Aggregation Step)

| Preparation of Aggregated Particles | |
|---|---|
| Resin particle dispersion (12) (contact angle with water: 82°) | 900 parts |
| Resin particle dispersion (14) (contact angle with water: 78°) | 225 parts |
| Colorant particle dispersion (1) | 100 parts |
| Releasing agent particle dispersion | 63 parts |
| Aluminum sulfate (produced by Wako Pure Chemical Industries, Ltd.) | 5 parts |
| Ion exchanged water | 1,000 parts |

The foregoing components are placed in a round flask made of stainless steel and adjusted to pH 2.0. The contents of the flask are dispersed by using a homogenizer (Ultra-Turrax T50, produced by IKA Corp.) and heated over an oil bath for heating to 64° C. under stirring. After maintaining at 61° C. for 3 hours, the observation by an optical microscope confirms that aggregated particles having an average particle diameter of about 5.0 μm are formed. After further maintaining at 61° C. for 4 hours, the observation by an optical microscope confirms that aggregated particles having an average particle diameter of about 5.4 μm are formed.

(Coalescing Step)

The aggregated particle dispersion has pH of 2.5. An aqueous solution obtained by diluting sodium hydrogencarbonate (produced by Wako Pure Chemical Industries, Ltd.) to 0.5% by weight is gradually added thereto to adjust the pH to 7.2, and the mixture is then heated to 90° C. under continuous stirring, followed by maintaining for 6 hours. Thereafter, the reaction product is filtered and sufficiently washed with ion exchanged water, followed by drying by using a vacuum dryer, so as to obtain toner particles.

The resulting toner particles have an average particle diameter of 5.5 μm. A developer for developing an electrostatic latent image (23) is produced by using the resulting toner particles in the same manner as in the developer for developing an electrostatic latent image (18).

Developer for Developing Electrostatic Latent Image (24)

(Aggregation Step)

| Preparation of Aggregated Particles | |
|---|---|
| Resin particle dispersion (7) (contact angle with water: 88°) | 2,850 parts |
| Resin particle dispersion (13) (contact angle with water: 79°) | 150 parts |
| Colorant particle dispersion (1) | 100 parts |
| Releasing agent particle dispersion | 63 parts |
| Lauroyl peroxide | 12 parts |
| Aluminum sulfate (produced by Wako Pure Chemical Industries, Ltd.) | 7 parts |
| Ion exchanged water | 150 parts |

The foregoing components are placed in a round flask made of stainless steel and adjusted to pH 2.0. The contents of the flask are dispersed by using a homogenizer (Ultra-Turrax T50, produced by IKA Corp.) and heated over an oil bath for heating to 63° C. under stirring. After maintaining at 63° C. for 2 hours, the observation by an optical microscope confirms that aggregated particles having an average particle diameter of about 4.6 μm are formed. After further maintaining at 63° C. for 3 hours, the observation by an optical microscope confirms that aggregated particles having an average particle diameter of about 4.8 μm are formed.

(Coalescing Step)

The aggregated particle dispersion has pH of 2.7. An aqueous solution obtained by diluting sodium hydrogencarbonate (produced by Wako Pure Chemical Industries, Ltd.) to 0.5% by weight is gradually added thereto to adjust the pH to 5.3, and the mixture is then heated to 90° C. under continuous stirring, followed by maintaining for 6 hours. Thereafter, the reaction product is filtered and sufficiently washed with ion exchanged water, followed by drying by using a vacuum dryer, so as to obtain toner particles.

The resulting toner particles have an average particle diameter of 4.8 μm. A developer for developing an electrostatic latent image (24) is produced by using the resulting toner particles in the same manner as in the developer for developing an electrostatic latent image (18).

Developer for Developing Electrostatic Latent Image (25)

(Aggregation Step)

| Preparation of Aggregated Particles | |
|---|---|
| Resin particle dispersion (7) (contact angle with water: 88°) | 1,650 parts |
| Resin particle dispersion (13) (contact angle with water: 79°) | 1,350 parts |
| Colorant particle dispersion (1) | 100 parts |
| Releasing agent particle dispersion | 63 parts |
| Lauroyl peroxide | 7 parts |
| Aluminum sulfate (produced by Wako Pure Chemical Industries, Ltd.) | 7 parts |
| Ion exchanged water | 120 parts |

The foregoing components are placed in a round flask made of stainless steel and adjusted to pH 2.0. The contents of the flask are dispersed by using a homogenizer (Ultra-Turrax T50, produced by IKA Corp.) and heated over an oil bath for heating to 65° C. under stirring. After maintaining at 65° C. for 3 hours, the observation by an optical microscope confirms that aggregated particles having an average particle diameter of about 4.1 μm are formed. After further maintaining at 65° C. for 2 hours, the observation by an optical microscope confirms that aggregated particles having an average particle diameter of about 4.3 μm are formed.

(Coalescing Step)

The aggregated particle dispersion has pH of 2.3. An aqueous solution obtained by diluting sodium hydrogencarbonate (produced by Wako Pure Chemical Industries, Ltd.) to 0.5% by weight is gradually added thereto to adjust the pH to 5.2, and the mixture is then heated to 90° C. under continuous stirring, followed by maintaining for 4 hours. Thereafter, the reaction product is filtered and sufficiently washed with ion exchanged water, followed by drying by using a vacuum dryer, so as to obtain toner particles.

The resulting toner particles have an average particle diameter of 4.4 μm. A developer for developing an electrostatic latent image (25) is produced by using the resulting toner particles in the same manner as in the developer for developing an electrostatic latent image (18).

Developer for Developing Electrostatic Latent Image (26)

(Aggregation Step)

| Preparation of Aggregated Particles | |
|---|---|
| Resin particle dispersion (7) (contact angle with water: 88°) | 2,347 parts |
| Resin particle dispersion (13) (contact angle with water: 79°) | 587 parts |
| Colorant particle dispersion (3) | 117 parts |
| Releasing agent particle dispersion | 63 parts |
| Lauroyl peroxide | 10 parts |
| Aluminum sulfate (produced by Wako Pure Chemical Industries, Ltd.) | 5 parts |
| Ion exchanged water | 100 parts |

The foregoing components are placed in a round flask made of stainless steel and adjusted to pH 2.1. The contents of the flask are dispersed by using a homogenizer (Ultra-Turrax T50, produced by IKA Corp.) and heated over an oil bath for heating to 68° C. under stirring. After maintaining at 68° C. for 3 hours, the observation by an optical microscope confirms that aggregated particles having an average particle diameter of about 4.8 μm are formed. After further maintaining at 68° C. for 2 hours, the observation by an optical microscope confirms that aggregated particles having an average particle diameter of about 5.0 μm are formed.

(Coalescing Step)

The aggregated particle dispersion has pH of 2.6. An aqueous solution obtained by diluting sodium carbonate (produced by Wako Pure Chemical Industries, Ltd.) to 0.5% by weight is gradually added thereto to adjust the pH to 5.9, and the mixture is then heated to 85° C. under continuous stirring, followed by maintaining for 3 hours. Thereafter, the reaction product is filtered and sufficiently washed with ion exchanged water, followed by drying by using a vacuum dryer, so as to obtain toner particles.

The resulting toner particles have an average particle diameter of 5.2 μm. A developer for developing an electrostatic latent image (26) is produced by using the resulting toner particles in the same manner as in the developer for developing an electrostatic latent image (18).

Developer for Developing Electrostatic Latent Image (27)

(Aggregation Step)

| Preparation of Aggregated Particles | |
|---|---|
| Resin particle dispersion (7) (contact angle with water: 88°) | 2,267 parts |
| Resin particle dispersion (13) (contact angle with water: 79°) | 567 parts |
| Colorant particle dispersion (2) | 250 parts |
| Releasing agent particle dispersion | 63 parts |
| Aluminum sulfate (produced by Wako Pure Chemical Industries, Ltd.) | 5 parts |
| Ion exchanged water | 100 parts |

The foregoing components are placed in a round flask made of stainless steel and adjusted to pH 2.1. The contents of the flask are dispersed by using a homogenizer (Ultra-Turrax T50, produced by IKA Corp.) and heated over an oil bath for heating to 68° C. under stirring. After maintaining at 68° C. for 3 hours, the observation by an optical microscope confirms that aggregated particles having an average particle diameter of about 4.9 μm are formed. After further maintaining at 68° C. for 3 hours, the observation by an optical microscope confirms that aggregated particles having an average particle diameter of about 5.3 μm are formed.

(Coalescing Step)

The aggregated particle dispersion has pH of 2.3. An aqueous solution obtained by diluting sodium carbonate (produced by Wako Pure Chemical Industries, Ltd.) to 0.5% by weight is gradually added thereto to adjust the pH to 5.5, and the mixture is then heated to 85° C. under continuous stirring, followed by maintaining for 3 hours. Thereafter, the reaction product is filtered and sufficiently washed with ion exchanged water, followed by drying by using a vacuum dryer, so as to obtain toner particles.

The resulting toner particles have an average particle diameter of 5.2 μm. A developer for developing an electrostatic latent image (27) is produced by using the resulting toner particles in the same manner as in the developer for developing an electrostatic latent image (18).

Developer for Developing Electrostatic Latent Image (28)

(Aggregation Step)

| Preparation of Aggregated Particles | |
|---|---|
| Resin particle dispersion (7) (contact angle with water: 88°) | 2,400 parts |
| Resin particle dispersion (13) (contact angle with water: 79°) | 600 parts |
| Colorant particle dispersion (4) | 109 parts |
| Releasing agent particle dispersion | 63 parts |
| Lauroyl peroxide | 10 parts |
| Aluminum sulfate (produced by Wako Pure Chemical Industries, Ltd.) | 5 parts |
| Ion exchanged water | 100 parts |

The foregoing components are placed in a round flask made of stainless steel and adjusted to pH 2.0. The contents of the flask are dispersed by using a homogenizer (Ultra-Turrax T50, produced by IKA Corp.) and heated over an oil bath for heating to 65° C. under stirring. After maintaining at 68° C. for 2 hours, the observation by an optical microscope confirms that aggregated particles having an average particle diameter of about 4.9 μm are formed. After further maintaining at 65° C. for 3 hours, the observation by an optical microscope confirms that aggregated particles having an average particle diameter of about 5.3 μm are formed.

(Coalescing Step)

The aggregated particle dispersion has pH of 2.3. An aqueous solution obtained by diluting sodium carbonate (produced by Wako Pure Chemical Industries, Ltd.) to 0.5% by weight is gradually added thereto to adjust the pH to 5.6, and the mixture is then heated to 90° C. under continuous stirring, followed by maintaining for 4 hours. Thereafter, the reaction product is filtered and sufficiently washed with ion exchanged water, followed by drying by using a vacuum dryer, so as to obtain toner particles.

The resulting toner particles have an average particle diameter of 5.5 μm. A developer for developing an electrostatic latent image (28) is produced by using the resulting toner particles in the same manner as in the developer for developing an electrostatic latent image (18).

Developer for Developing Electrostatic Latent Image (29)

(Aggregation Step)

| Preparation of Aggregated Particles | |
|---|---|
| Resin particle dispersion (7) (contact angle with water: 88°) | 2,400 parts |
| Resin particle dispersion (14) (contact angle with water: 78°) | 225 parts |
| Colorant particle dispersion (1) | 109 parts |

-continued

| Preparation of Aggregated Particles | |
|---|---|
| Releasing agent particle dispersion | 65 parts |
| Lauroyl peroxide | 10 parts |
| Aluminum sulfate (produced by Wako Pure Chemical Industries, Ltd.) | 5 parts |
| Ion exchanged water | 100 parts |

The foregoing components are placed in a round flask made of stainless steel and adjusted to pH 2.0. The contents of the flask are dispersed by using a homogenizer (Ultra-Turrax T50, produced by IKA Corp.) and heated over an oil bath for heating to 66° C. under stirring. After maintaining at 65° C. for 3 hours, the observation by an optical microscope confirms that aggregated particles having an average particle diameter of about 4.3 μm are formed. After further maintaining at 65° C. for 2 hours, the observation by an optical microscope confirms that aggregated particles having an average particle diameter of about 4.5 μm are formed.

(Coalescing Step)

The aggregated particle dispersion has pH of 2.6. An aqueous solution obtained by diluting sodium carbonate (produced by Wako Pure Chemical Industries, Ltd.) to 0.5% by weight is gradually added thereto to adjust the pH to 5.9, and the mixture is then heated to 90° C. under continuous stirring, followed by maintaining for 4 hours. Thereafter, the reaction product is filtered and sufficiently washed with ion exchanged water, followed by drying by using a vacuum dryer, so as to obtain toner particles.

The resulting toner particles have an average particle diameter of 4.8 μm. A developer for developing an electrostatic latent image (29) is produced by using the resulting toner particles in the same manner as in the developer for developing an electrostatic latent image (18).

Developer for Developing Electrostatic Latent Image (30)

(Aggregation Step)

| Preparation of Aggregated Particles | |
|---|---|
| Resin particle dispersion (12) (contact angle with water: 82°) | 900 parts |
| Resin particle dispersion (13) (contact angle with water: 79°) | 600 parts |
| Colorant particle dispersion (1) | 100 parts |
| Releasing agent particle dispersion | 63 parts |
| Lauroyl peroxide | 10 parts |
| Aluminum sulfate (produced by Wako Pure Chemical Industries, Ltd.) | 5 parts |
| Ion exchanged water | 100 parts |

The foregoing components are placed in a round flask made of stainless steel and adjusted to pH 2.0. The contents of the flask are dispersed by using a homogenizer (Ultra-Turrax T50, produced by IKA Corp.) and heated over an oil bath for heating to 65° C. under stirring. After maintaining at 65° C. for 3 hours, the observation by an optical microscope confirms that aggregated particles having an average particle diameter of about 5.3 μm are formed. After further maintaining at 65° C. for 2 hours, the observation by an optical microscope confirms that aggregated particles having an average particle diameter of about 5.6 μm are formed.

(Coalescing Step)

The aggregated particle dispersion has pH of 2.3. An aqueous solution obtained by diluting sodium carbonate (produced by Wako Pure Chemical Industries, Ltd.) to 0.5% by weight is gradually added thereto to adjust the pH to 5.0, and the mixture is then heated to 90° C. under continuous stirring, followed by maintaining for 4 hours. Thereafter, the reaction product is filtered and sufficiently washed with ion exchanged water, followed by drying by using a vacuum dryer, so as to obtain toner particles.

The resulting toner particles have an average particle diameter of 5.7 μm. A developer for developing an electrostatic latent image (30) is produced by using the resulting toner particles in the same manner as in the developer for developing an electrostatic latent image (18).

Developer for Developing Electrostatic Latent Image (31)

(Aggregation Step)

| Preparation of Aggregated Particles | |
|---|---|
| Resin particle dispersion (7) (contact angle with water: 88°) | 3,000 parts |
| Colorant particle dispersion (1) | 100 parts |
| Releasing agent particle dispersion | 63 parts |
| Lauroyl peroxide | 10 parts |
| Aluminum sulfate (produced by Wako Pure Chemical Industries, Ltd.) | 5 parts |
| Ion exchanged water | 100 parts |

The foregoing components are placed in a round flask made of stainless steel and adjusted to pH 2.0. The contents of the flask are dispersed by using a homogenizer (Ultra-Turrax T50, produced by IKA Corp.) and heated over an oil bath for heating to 65° C. under stirring. After maintaining at 65° C. for 2 hours, the observation by an optical microscope confirms that aggregated particles having an average particle diameter of about 5.1 μm are formed. After further maintaining at 65° C. for 2 hours, the observation by an optical microscope confirms that aggregated particles having an average particle diameter of about 5.3 μm are formed.

(Coalescing Step)

The aggregated particle dispersion has pH of 2.2. An aqueous solution obtained by diluting sodium carbonate (produced by Wako Pure Chemical Industries, Ltd.) to 0.5% by weight is gradually added thereto to adjust the pH to 4.5, and the mixture is then heated to 90° C. under continuous stirring, followed by maintaining for 4 hours. Thereafter, the reaction product is filtered and sufficiently washed with ion exchanged water, followed by drying by using a vacuum dryer, so as to obtain toner particles.

The resulting toner particles have an average particle diameter of 5.5 μm. A developer for developing an electrostatic latent image (31) is produced by using the resulting toner particles in the same manner as in the developer for developing an electrostatic latent image (18).

EXAMPLE 17

A modified machine of a color duplicator, Acolor 930, produced by Fuji Xerox Co., Ltd. is prepared in the following manner. The releasing oil supplying unit of the duplicator is detached, and a fixing unit containing a fixing roll and a pressure roll, which are covered with films of a ethylene-vinylidene fluoride-tetrafluoroethylene copolymer on the surfaces thereof, is installed. The developer for developing an electrostatic latent image (18) is installed in a developer of the modified duplicator, and a non-fixed image is prepared to have a solid part and a thin line part. The non-fixed image is fixed in such a manner that the rotation speed of the roll is adjusted to make the contact time of the fixing roll and the non-fixed image be 0.04 second, with the surface temperature of the fixing roll varying from 60 to 200° C. at an interval of 5° C. The fixed image is folded inside at the substantial center of the solid part of the fixed image to evaluate the breakage of the fixed image, and the fixing temperature where no problem occurs is designated as the lowest fixing temperature. Reproducibility of the thin lines, background fogging and hot offset are evaluated with the naked eye. Furthermore, the toner used is evaluated for the characteristics, the particle size, the particle size distribution and the fixing characteristics. The results are shown in Tables 3 and 4 below.

In the tables, Tm represents the melting point of the toner, GL(30) represents the storage elastic modulus at 30° C.; GL(Tm) and GL(Tm+10) represent the storage elastic modulus at the melting point and that at a temperature higher by 10° C. than the melting point, respectively; GN(Tm) and GN(Tm+10) represent the loss elastic modulus at the melting point and that at a temperature higher by 10° C. than the melting point, respectively; Δlog GL represents |log GL(Tm+20)−log GL(Tm+50)|; and Δlog GN represents |log GN(Tm+20)−log GN(Tm+50)|.

EXAMPLES 18 TO 29

COMPARATIVE EXAMPLES 4

Evaluation is conducted in the same manner as in Example 17 except that the developers for developing an electrostatic latent image (19) to (31) are used instead of the developer for developing an electrostatic latent image (18). The results are shown in Tables 3 and 4.

TABLE 3

| | Developer | Tm (° C.) | GL(30) × $10^5$ | GL(Tm) × $10^5$ | GL(Tm + 10) × $10^3$ | GN(Tm) × $10^5$ | GN(Tm + 10) × $10^3$ | Δlog GL | Δlog GN |
|---|---|---|---|---|---|---|---|---|---|
| Example 17 | 18 | 69 | 3.2 | 2.8 | 4.2 | 4.0 | 4.6 | 1.2 | 1.2 |
| Example 18 | 19 | 85 | 5.9 | 6.6 | 6.2 | 7.0 | 5.2 | 1.2 | 1.3 |
| Example 19 | 20 | 60 | 1.5 | 1.2 | 9.2 | 3.1 | 8.2 | 1.1 | 1.0 |
| Example 20 | 21 | 81 | 4.8 | 4.0 | 2.2 | 6.5 | 2.5 | 0.2 | 0.4 |
| Example 21 | 22 | 67 | 8.0 | 7.6 | 1.5 | 9.3 | 1.3 | 0.7 | 0.5 |
| Example 22 | 23 | 60 | 3.5 | 3.4 | 8.3 | 3.9 | 8.0 | 0.3 | 0.4 |
| Example 23 | 24 | 71 | 3.2 | 2.8 | 5.2 | 4.1 | 8.5 | 1.1 | 1.3 |
| Example 24 | 25 | 66 | 3.2 | 2.8 | 4.8 | 4.0 | 4.5 | 1.0 | 1.0 |
| Example 25 | 26 | 69 | 3.2 | 2.8 | 5.0 | 4.3 | 4.5 | 0.8 | 0.7 |
| Example 26 | 27 | 69 | 3.2 | 2.8 | 4.9 | 4.2 | 5.1 | 1.2 | 1.1 |
| Example 27 | 28 | 69 | 3.2 | 2.8 | 4.6 | 4.3 | 4.6 | 0.8 | 0.5 |

TABLE 3-continued

| | Developer | Tm (° C.) | GL(30) × $10^5$ | GL(Tm) × $10^5$ | GL(Tm + 10) × $10^3$ | GN(Tm) × $10^5$ | GN(Tm + 10) × $10^3$ | Δlog GL | Δlog GN |
|---|---|---|---|---|---|---|---|---|---|
| Example 28 | 29 | 69 | 3.2 | 2.8 | 3.8 | 4.2 | 1.6 | 0.9 | 0.5 |
| Example 29 | 30 | 61 | 3.2 | 2.8 | 5.2 | 4.2 | 4.0 | 1.1 | 1.5 |
| Comparative Example 4 | 31 | 72 | 3.1 | 2.6 | 3.2 | 4.6 | 1.2 | 1.3 | 1.0 |

TABLE 4

| | Developer | Average diameter (μm) | GSDv | Tan δ | Fixing temperature (° C.) | Reproducibility of thin lines | Background fogging | Hot offset |
|---|---|---|---|---|---|---|---|---|
| Example 17 | 18 | 5.3 | 1.21 | 0.91 | 85 | good | none | no occurrence |
| Example 18 | 19 | 7.2 | 1.20 | 1.19 | 100 | good | none | no occurrence |
| Example 19 | 20 | 4.3 | 1.24 | 1.12 | 75 | good | none | no occurrence |
| Example 20 | 21 | 5.7 | 1.22 | 0.88 | 95 | good | none | no occurrence |
| Example 21 | 22 | 5.4 | 1.22 | 1.15 | 80 | good | none | no occurrence |
| Example 22 | 23 | 5.5 | 1.23 | 1.04 | 80 | good | none | no occurrence |
| Example 23 | 24 | 4.8 | 1.20 | 0.63 | 85 | good | none | no occurrence |
| Example 24 | 25 | 4.4 | 1.22 | 1.07 | 90 | good | none | no occurrence |
| Example 25 | 26 | 5.2 | 1.20 | 1.11 | 85 | good | none | no occurrence |
| Example 26 | 27 | 5.2 | 1.25 | 0.96 | 85 | good | none | no occurrence |
| Example 27 | 28 | 5.5 | 1.25 | 1.00 | 85 | good | none | no occurrence |
| Example 28 | 29 | 4.8 | 1.25 | 2.38 | 85 | good | none | no occurrence |
| Example 29 | 30 | 5.7 | 1.24 | 1.30 | 85 | good | none | no occurrence |
| Comparative Example 4 | 31 | 5.5 | 1.38 | 2.67 | 85 | slightly poor | slight occurrence | no occurrence |

It is understood from Tables 3 and 4 that when the developers for developing an electrostatic latent image containing the toners for developing an electrostatic latent image in Examples 17 to 29 are used, in comparison to the developer for developing an electrostatic latent image containing the toner for developing an electrostatic latent image in Comparative Example 4, the particle size distribution becomes narrow, i.e., the particle diameters of the respective particles of the toner can be uniformized, and therefore the toners are excellent in reproducibility of thin lines, cause no background fogging, and are excellent in low temperature fixing property. Furthermore, it is also understood that the toners are excellent in image stability upon high speed fixing particularly in the case where a color toner is used.

Owing to the foregoing constitution, the invention can provide a toner for developing an electrostatic latent image having excellent low temperature fixing property and containing a colorant and a releasing agent uniformly dispersed. The invention can provide a toner for developing an electrostatic latent image and a process for producing the same, as well as a developer for developing an electrostatic latent image and a process for forming an image using the same, which toner is produced by a simple production process, has good reproducibility particularly in particle size and particle size distribution, is excellent in production stability, has a wide fixing region, and is excellent in low temperature fixing property. The invention can provide a toner for developing an electrostatic latent image and a process for producing the same, as well as a developer for developing an electrostatic latent image and a process for forming an image using the same, which toner is excellent in production stability and storage stability of resin particles formed by the aggregation process, and is excellent in charging property, particularly environmental stability and time-lapse stability, whereby an excellent image can be formed even by a machine using a belt type fixing unit or a high speed fixing unit, which have a low heating ability upon fixing.

The entire disclosure of Japanese Patent Applications No. 2000-260311 filed on Aug. 30, 2000 including specification, claims, drawings and abstract and No. 2000-303912 filed on Oct. 3, 2000 including specification, claims and abstract is incorporated herein by reference in its entirety.

What is claimed is:

1. A toner for developing an electrostatic latent image comprising: a crystalline resin having a melting point as a binder resin; and at least one compound which is selected from (A) an ester compound having an alkyl group having from 6 to 32 carbon atoms and (B) a resin having a contact angle with water that is smaller than that of the crystalline resin, wherein the toner satisfies the following equation (1):

$$0 \leqq |\log GL(Tm+20) - \log GL(Tm+50)| \leqq 1.5 \quad (1)$$

wherein Tm represents a melting point of the toner, GL(Tm+20) represents a storage elastic modulus at Tm+20° C., and GL(Tm+50) represents a storage elastic modulus at Tm+50° C., and the following equation (2):

$$0 \leqq |\log GN(Tm+20) - \log GN(Tm+50)| \leqq 1.5 \quad (2)$$

wherein GN(Tm+20) represents a loss elastic modulus at Tm+20° C., and GN(Tm+50) represents a loss elastic modulus at Tm+50° C.

2. The toner for developing an electrostatic latent image as claimed in claim 1, wherein the toner satisfies the following property: when the temperature is changed within a temperature range of about from 40 to 110° C., values of a storage elastic modulus and a loss elastic modulus have an area which is changed by $10^2$ or more per a temperature difference of 10° C.

3. The toner for developing an electrostatic latent image as claimed in claim 1, wherein the toner has a storage elastic modulus at 30° C. at an angular frequency of 1 rad/sec of about $1\times10^5$ Pa or more.

4. The toner for developing an electrostatic latent image as claimed in claim 1, wherein the toner further comprises a releasing agent.

5. The toner for developing an electrostatic latent image as claimed in claim 1, wherein the ester compound has a molecular weight of about from 200 to 1,500.

6. The toner for developing an electrostatic latent image as claimed in claim 1, wherein the crystalline resin is a polymerized monomer which contains a sulfonyl group-containing monomer.

7. The toner for developing an electrostatic latent image as claimed in claim 1, wherein the toner has a loss tangent tan δ at Tm+20° C., where Tm represents a melting point of the toner, satisfying $0.01 \leqq \tan\delta \leqq 2$ at an angular frequency of 1 rad/sec.

8. The toner for developing an electrostatic latent image as claimed in claim 1, wherein the resin has a contact angle with water that is smaller than that of the crystalline resin, the contact angle with water being about from 30 to 120°.

9. The toner for developing an electrostatic latent image as claimed in claim 1, wherein the resin has a contact angle with water that is smaller than that of the crystalline resin by about 3° or more.

10. A process for forming an image, comprising the steps of: forming an electrostatic latent image; developing the electrostatic latent image with a developer to form a toner image; transferring the toner image to a fixing substrate; and fixing the toner image to the fixing substrate, wherein the toner for developing an electrostatic latent image as claimed in claim 1 is used to form the toner image.

11. The process for forming an image as claimed in claim 10, wherein in the fixing step, a contact time of a fixing member and an unfixed image on the fixing substrate is adjusted to a range of about from 0.01 to 0.05 second.

12. The process for forming an image as claimed in claim 10, wherein in the fixing step, a belt type fixing unit is used.

13. A process for producing a toner for developing an electrostatic latent image comprising the steps of:

mixing by agitating (1) a binder resin particle dispersion comprising a crystalline resin and (2) an aggregated particle stabilizer dispersion comprising at least one compound which is selected from (A) an ester compound having an alkyl group having from 6 to 32 carbon atoms and (B) a resin having a contact angle with water that is smaller than that of the crystalline resin to prepare an aggregated particle dispersion containing the binder resin particles; and heating the aggregated particle dispersion to a temperature higher than a melting point of the crystalline resin to form toner particles, wherein the toner satisfies the following equation (1):

$$0 \leqq |\log GL(Tm+20) - \log GL(Tm+50)| \leqq 1.5 \quad (1)$$

wherein Tm represents a melting point of the toner, GL(Tm+20) represents a storage elastic modulus at Tm+20° C., and GL(Tm+50) represents a storage elastic modulus at Tm+50° C., and the following equation (2):

$$0 \leqq |\log GN(Tm+20) - \log GN(Tm^{\circ}50)| \leqq 1.5 \quad (2)$$

wherein GN(Tm+20) represents a loss elastic modulus at Tm+20° C., and GN(Tm+50) represents a loss elastic modulus at Tm+50° C.

14. The process for producing a toner for developing an electrostatic latent image as claimed in claim 13, comprising the steps of: mixing by agitating a binder resin particle dispersion, a colorant particle dispersion and an aggregated particle stabilizer dispersion to prepare an aggregated particle dispersion containing the binder resin particles and the colorant particles; and heating the aggregated particle dispersion to a temperature higher than a melting point of a crystalline resin contained in the binder resin to form toner particles.

* * * * *